US006811837B2

(12) United States Patent
Iwasa et al.

(10) Patent No.: US 6,811,837 B2
(45) Date of Patent: Nov. 2, 2004

(54) POROUS RESIN FILM

(75) Inventors: Yasuo Iwasa, Ibaraki (JP); Seiichiro Iida, Ibaraki (JP); Nobuhiro Shibuya, Ibaraki (JP)

(73) Assignee: Yupo Corporation, Tokyo (JP)

( * ) Notice: Subject to any disclaimer, the term of this patent is extended or adjusted under 35 U.S.C. 154(b) by 45 days.

(21) Appl. No.: 10/165,280

(22) Filed: Jun. 10, 2002

(65) Prior Publication Data

US 2003/0071884 A1 Apr. 17, 2003

Related U.S. Application Data

(63) Continuation of application No. PCT/JP00/08634, filed on Dec. 6, 2000.

(30) Foreign Application Priority Data

Dec. 10, 1999 (JP) ..... 11-351889
May 26, 2000 (JP) ..... 2000-156094
May 26, 2000 (JP) ..... 2000-156095

(51) Int. Cl.[7] ..... B41M 5/40

(52) U.S. Cl. ..... 428/32.17; 428/32.18; 428/32.25; 428/32.26; 428/32.3; 428/32.33; 428/32.36

(58) Field of Search ..... 428/32.17, 32.18, 428/32.25, 32.26, 32.3, 32.33, 32.35, 32.36, 407, 195, 206, 212, 32.5, 332, 474.4

(56) References Cited

U.S. PATENT DOCUMENTS

| | | | | |
|---|---|---|---|---|
| 5,489,471 A | | 2/1996 | Inoue et al. | 428/304.4 |
| 6,086,987 A | * | 7/2000 | Yamanaka et al. | 428/330 |
| 6,332,940 B1 | * | 12/2001 | Lin | 156/229 |
| 6,589,636 B2 | * | 7/2003 | Emslander et al. | 428/343 |
| 2002/0012786 A1 | * | 1/2002 | Iwasa et al. | 428/317.9 |

FOREIGN PATENT DOCUMENTS

| | | |
|---|---|---|
| EP | 0 855 420 | 7/1998 |
| EP | 0 858 905 | 8/1998 |
| JP | 62-227933 | 10/1987 |
| JP | 10-278417 | 10/1998 |

OTHER PUBLICATIONS

U.S. patent application Ser. No. 09/832,924, filed Apr. 12, 2001, pending.
U.S. patent application Ser. No. 10/163,372, filed Jun. 7, 2002, pending.
U.S. patent application Ser. No. 10/159,112, filed Jun. 3, 2002, pending.
U.S. patent application Ser. No. 10/244,075, filed Sep. 16, 2002, pending.
U.S. patent application Ser. No. 10/165,280, filed Jun. 10, 2002, pending.

* cited by examiner

*Primary Examiner*—B. Shewareged
(74) *Attorney, Agent, or Firm*—Oblon, Spivak, McClelland, Maier & Neustadt, P.C.

(57) ABSTRACT

The invention provides a porous resin film having a good absorption of water content as a solvent for aqueous ink or aqueous paste and a recording medium comprising the porous resin film. The recording medium is characterized by the capability of absorbing an ink without density unevenness even during ink jet recording if the ejected amount of ink is great. The invention lies in a porous resin film comprising: a thermoplastic resin in an amount of 30 to 90% by weight; and an inorganic and/or organic finely divided powder in an amount of 10 to 70% by weight, wherein the inorganic and/or organic finely divided powder is surface-treated with a surface treating agent (A) made of a copolymer of diallylamine salt or alkyl diallylamine salt (a1) with a nonionic hydrophilic vinyl monomer (a2) and an anionic surface treating agent (B), and the porous resin film has a liquid absorption capacity of not smaller than 0.5 ml/m$^2$ as measured by "Japan TAPPI No. 51-87".

22 Claims, No Drawings

POROUS RESIN FILM

TECHNICAL FIELD

The present invention relates to a porous resin film having excellent aqueous liquid absorbency and ink absorbency. The invention also relates to a recording medium which exhibits good ink jet recording properties and which allows the formation of a fine image.

BACKGROUND OF THE INVENTION

A film-based synthetic paper having excellent water resistance comprises a resin as a main component and has heretofore been mainly used for offset printing or seal printing using oil-based or UV curing ink, sublimation, or melt type heat transfer, etc. As the film-based synthetic paper has found more applications, however, there has been a growing demand for printing methods using an aqueous ink and aqueous paste for environmental protection purposes. To this end, synthetic paper having good absorption of aqueous ink, aqueous paste, or water, which acts as a solvent therefor, would be desirable.

The recent progress of multimedia techniques means that ink jet process printers have become popular for use in both business or consumer applications. The ink jet process printer can be easily provided in the form of a multi-color display, and it can easily provide a large image. Thus, it desirably reduces the printing cost. In particular, ink jet printers using an aqueous ink, which has fewer environmental or safety problems as compared with oil-based ink, have become popular recently.

The ink jet printer has been widely used to obtain a hard copy with characters as well as images. Therefore, the printed image must be finer. The image fineness depends on the dryability of the ink printed on the recording medium. For example, when repeated printing is made on a plurality of recording medium sheets, other sheets of recording medium are often imposed on the printed recording medium. In this case, if the printed recording medium sheet has absorbed the ink insufficiently, the ink can transfer to the preceding recording medium sheet, causing image stain.

In order to enhance the fineness of image, a method has been widely employed which comprises coating an ink-receptive material that contains a hydrophilic resin or inorganic finely divided powder onto a recording medium such as plastic film or paper (Japanese Patent Laid-Open No. 1991-82589, Japanese Patent Laid-Open No. 1997-216456). A recording medium for ink jet recording having an ink-receptive layer mainly composed of a hydrophilic resin formed by heat lamination or extrusion lamination has also been proposed (Japanese Patent Laid-Open No. 1996-12871, Japanese Patent Laid-Open No. 1997-1920, Japanese Patent LaidOpen No. 1997-314983). However, the recording media formed by these methods have the disadvantage in that when the ejected amount of ink is great, the media cannot absorb the ink sufficiently, which requires that the thickness of the coat layer be increased, and which requires a plurality of coating steps.

An aim of the invention is to solve the problems of the conventional techniques.

In other words, an aim of the invention is to provide a porous resin film having good water absorption from aqueous inks or aqueous pastes and a recording medium which can absorb ink without density unevenness even if solid printing is carried out in which the ejected amount of ink is great in ink jet recording. Another aim of the invention is to provide a porous resin film constituting such a recording medium having excellent properties.

DISCLOSURE OF THE INVENTION

The inventors made extensive studies for the purpose of solving the aforementioned problems As a result, it was found that a porous resin film comprising a thermoplastic resin and an inorganic and/or organic finely divided powder treated with a surface treating agent (A) made of a copolymer of an amine salt selected from diallylamine salt and alkyl diallylamine salt with a nonionic hydrophilic vinyl monomer and an anionic surface treating agent (B) and having a liquid-absorption capacity of not smaller than 0.5 $ml/m^2$ as measured by "Japan TAPPI No. 51-87" exhibits good aqueous liquid absorbency and, when it has a surface contact angle of not greater than 110°, can absorb ink without density unevenness even if the ejected amount of ink is great and thus can be preferably used as a recording medium for ink jet recording or the like. Thus, the invention has been worked out.

The term "surface treating agent (A) made of a copolymer of an amine salt selected from diallylamine salt and alkyl diallylamine salt with a nonionic hydrophilic vinyl monomer" as used hereinafter will be referred to as "surface treating agent (A)".

In other words, the invention lies in a porous resin film comprising a thermoplastic resin and an inorganic and/or organic finely divided powder treated with a surface treating agent (A) and an anionic surface treating agent (B) and having a liquid absorption capacity of not smaller than 0.5 $ml/m^2$ as measured by "Japan TAPPI No. 51-87". In a preferred embodiment, the average contact angle of the film with respect to water is not greater than 110°, and more preferably, the porous resin film has pores in the surface and the interior thereof and exhibits a porosity of not smaller than 10%.

The film preferably has pores in the surface layer in an amount of $1\times10^6/m^2$, and the average diameter of the pores in the surface layer is preferably from 0.01 $\mu$m to 50 $\mu$m. Preferably, at least a part of the inorganic and/or organic finely divided powder is present in the pores in the surface layer and/or the interior of the film.

The thermoplastic resin is preferably a polyolefin-based resin, and the inorganic and/or organic finely divided powder preferably has an average particle diameter of from 0.01 $\mu$m to 20 $\mu$m. The specific surface area of the inorganic or organic finely divided powder preferably falls within a range of not smaller than 05 $m^2/g$.

Referring to a preferred embodiment of the mixing proportion of the constituents, the content of the thermoplastic resin is from 30 to 90% by weight, the content of the surface-treated inorganic or organic finely divided powder is from 10 to 70% by weight, and the proportion of the surface treating agent (A) and the surface treating agent (B) are each from 0.01 to 10 parts by weight based on 100 parts by weight of the inorganic and/or organic finely divided powder.

Referring to preferred surface treating agents, the surface treating agent (A) is a copolymer of monomer (A1) selected from diallylamine salt and alkyl diallylamine salt with a nonionic hydrophilic vinyl monomer (A2) selected from acrylamide and methacrylamide, and the anionic surface treating agent (B) is selected from the group consisting of sulfonic acid salt, phosphoric acid ester salt and betaine having a $C_4$–$C_{40}$ hydrocarbon group.

In another preferred embodiment, the porous resin film is stretched. The invention includes a laminated film comprising a porous resin film layer provided on at least one surface of a substrate, a recording medium comprising same, and an ink jet recording medium comprising a colorant-fixing layer provided thereon.

The ink-receptive layer preferably comprises an inorganic filler of not greater than 350 nm and a binder resin incorporated therein in an amount of from 70 to 95% by weight and from 5 to 30% by weight, respectively. The inorganic filler is preferably an amorphous silica and/or alumina and/or alumina hydrate, and in particular, the amorphous silica is obtained by agglomerating primary particles having an average diameter of from 1 nm to 10 nm. The amorphous silica is preferably a cationically treated silica.

The alumina is preferably δ-alumina, and the alumina hydrate is preferably pseudo-boehmite.

The ink-receptive layer preferably comprises a crosslinking agent and an ink fixing agent incorporated therein each in an amount of from 1 to 20% by weight.

A top coat layer is preferably provided on the ink-receptive layer, and the surface gloss of the top coat layer is preferably not smaller than 50% (as measured at 60° according to JIS-Z8741). The top coat layer preferably comprises an inorganic filler having an average particle diameter of not greater than 350 nm, a binder resin incorporated therein and further an ink fixing agent in an amount of from 70 to 95% by weight, from 5 to 30% by weight, and from 1 to 20% by weight, respectively.

BEST MODE FOR CARRYING OUT THE INVENTION

The porous resin film and recording medium of the invention will be further described hereinafter.

The liquid absorption capacity of the porous resin film of the invention is not smaller than 0.5 ml/m$^2$, preferably from 3 to 2,600 ml/m$^2$, more preferably from 5 to 100 ml/m$^2$, still more preferably 7 to 100 ml/m$^2$.

When the liquid absorption capacity of the porous resin film falls below 0.5 ml/m$^2$, the porous resin film exhibits an insufficient absorption of aqueous ink and aqueous paste. Since it is also necessary that the thickness of the porous resin film be taken into account to increase the absorption, the upper limit of the liquid absorption capacity is properly predetermined depending on the purpose.

The liquid absorption capacity of the porous resin film of the invention is measured according to "Japan TAPPI No. 51-87" (JAPAN TAPPI, paper pulp testing method No. 51-87; Bristow Method). In the invention, the value measured in 2 seconds of absorption time is defined as liquid absorption capacity. The solvent used in the measurement is obtained by adding a coloring dye to 100% by weight of a mixture of 70% by weight of water and 30% by weight of ethylene glycol. As the coloring dye malachite green or the like is used in an amount of about 2 parts by weight based on 100 parts by weight of the mixed solvent, but the kind and amount of the coloring dye used is not specifically limited so far as they do not change drastically the surface tension of the solvent used in the measurement.

The measuring instrument may be, e.g., a liquid absorbency testing machine produced by Kumagai Riki Kogyo K.K.

The greater the liquid absorption capacity in a short period of absorption time is, the less likely that an aqueous paste, if used, can come out from the edge of paper. In the invention, the liquid absorption capacity in 40 milliseconds is preferably not smaller than 0.8 ml/m$^2$, more preferably from 1 to 500 ml/m$^2$.

The greater the liquid absorption speed measured with the measurement of the aforementioned liquid absorption capacity is, the better the results of absorption by and drying of color-imposed area tend to be. The absorption speed between 20 milliseconds to 400 milliseconds is normally not smaller than 0.02 ml/$\{m^2\cdot(ms)^{1/2}\}$, preferably from 0.1 to 100 ml/$\{m^2\cdot(ms)^{1/2}\}$.

The surface contact angle of the porous resin film of the invention with respect to water is not greater than 110°, preferably from 0 to 100°, more preferably from 0 to 90°.

When the surface contact angle of the porous resin film exceeds 110°, the penetration of a liquid such as paste comprising an aqueous ink or aqueous medium is not sufficient. From the standpoint of the requirements that the spread of an aqueous ink droplet in the direction parallel to the surface of film and the penetration of the aqueous ink droplet into the film in the thickness direction be balanced, there can be a proper range of contact angle, and the contact angle is properly predetermined according to the type of ink.

The surface contact angle of the film of the invention with respect to water is measured by dropping purified water onto the surface of the film, and then measuring the contact angle of the film after 1 minute. Ten measurements are made on one specimen. Once measured, the specimen is replaced by an unmeasured specimen which is not yet wet with purified water for measurement of contact angle. These measurements are then averaged to determine the contact angle with water. An example of commercially available contact angle meter which can be used to measure the contact angle of the invention is a Type CA-D contact angle meter produced by KYOWA INTERFACE SCIENCE CORPORATION LIMITED.

The smaller the "difference between maximum value and minimum value" in the ten measurements of contact angle is, the more uniform the absorption of the ink or the liquid comprising an aqueous medium tends to be and the better is the print quality given by the printing medium. By way of example, the difference between maximum value and minimum value is not greater than 40°, preferably not greater than 30°, more preferably not greater than 20°.

The porous resin film of the invention has fine pores in the surface thereof and absorbs an aqueous ink or aqueous liquid in contact with the surface through the pores. The number and shape of the pores in the surface of the porous resin film and the presence of at least a part of the inorganic and/or organic finely divided powder in the surface pores can be determined by observation under an electron microscope.

The shape of pores in the surface of the porous resin film can be observed by cutting an arbitrary part out of the porous resin film specimen, sticking the specimen to an observation specimen carrier, vacuum-evaporating gold, gold-palladium or the like onto the surface of the specimen to be observed, and then observing the specimen under a Type S-2400 scanning electron microscope produced by HITACHI LTD. or the like at any magnification power allowing easy observation to determine the number, size and shape of pores.

The number of pores per unit area on the surface of the porous resin film is not smaller than $1\times10^6$/m$^2$, preferably not smaller than $1\times10^7$/m$^2$, more preferably not smaller than $1\times10^8$/m$^2$ from the standpoint of enhancement of absorption of aqueous liquid. From the standpoint of enhancement of surface strength to a higher level, it is preferably not greater than $1\times10^{15}$/m$^2$, more preferably not greater than $1\times10^{12}$/m$^2$.

The shape of pores in the vicinity of the surface of the porous resin film can vary from circular to ellipsoidal. The average [(L+M)/2] of measurements of the maximum diameter (L) of each of the pores and the maximum diameter (M) in the direction perpendicular thereto is defined to be the average diameter of the pore. The measurement is repeatedly made on at least 20 surface pores, and the average of the measurements is defined to be the average diameter of pores in the surface of the porous resin film. From the standpoint of enhancement of liquid absorbency to a higher level, the average diameter is preferably not smaller than 0.01 μm, more preferably not smaller than 0.1 μm, even more preferably not smaller than 1 μm. In order to enhance the surface strength of the porous resin film to a higher level, the average diameter is not greater than 50 μm, preferably not greater than 30 μm, more preferably not greater than 20 μm.

Preferably, at least a part, preferably not less than about 30% of the pores in the surface layer and in its vicinity has an inorganic and/or organic finely divided powder present in the interior thereof and its surrounding. As the number of such pores increases, the absorbency tends to increase.

The porous resin film of the invention has a porous structure with numerous fine pores in the interior thereof, and from the standpoint of enhancement of absorption and dryability of aqueous ink, the porosity thereof is not smaller than 10%, preferably from 20 to 75%, more preferably from 30 to 65%. When the porosity is not greater than 75%, the strength of the film material is on a good level.

Preferably, at least a part of the internal pores has an inorganic and/or organic finely divided powder present in the interior thereof and its surrounding. As the number of such pores increases, the absorbency tends to increase.

The presence of pores in the interior of the porous resin film and the presence of an inorganic and/or organic finely divided powder in the internal pores can be confirmed by observing the section of the film under an electron microscope.

The porosity in the present description indicates the porosity represented by the following equation (1) or the percent area proportion (%) of pores in the region on the section observed under an electron microscope.

$$\text{Porosity } (\%) = 100\ (\rho_0 - \rho)/\rho_0 \qquad (1)$$

($\rho_0$: Density of nonporous portion of porous resin film, $\rho$: Density of porous resin film)

In some detail, the porous resin film is embedded in an epoxy resin which is then solidified, cut by a microtome so that sections are formed in the direction parallel to the thickness direction and in the direction perpendicular to the surface of the film, respectively, metallized on the sections, and then observed on the sections at an arbitrary power of magnification allowing easy observation, e.g., from 500 to 2,000. By way of example, the region thus observed is photographed. The photograph of pores is then traced to a tracing film. The drawing obtained by smearing away the area of pores can then be image-processed by an image analyzer (LUZEX IID, produced by NIRECO CORPORATION) to determine the percent area of pores from which the porosity can be calculated. In the case of a laminated film having a porous resin film of the invention provided on the surface thereof, the thickness and basis weight of the porous resin film of the invention are calculated from the thickness and basis weight (g/m$^2$) of the laminated film and the portion obtained by excluding the porous resin film of the invention from the laminated film to determine the density ($\rho$). The density ($\rho_0$) of the nonporous portion is determined from the formulation of the constituents. Then, the porosity can be determined by the equation (1).

The shape or dimension of the internal pores can be observed at a power of magnification allowing easy observation under a scanning electron microscope, e.g., 500 to 2,000. The dimension of the internal pores is determined by averaging the measurements of dimension of at least 10 internal pores in the surface direction and thickness direction.

The average dimension of the pores in the porous resin film in the surface direction is from 0.1 μm to 1,000 μm, preferably from 1 μm to 500 μm. From the standpoint of enhancement of the mechanical strength of the porous resin film to a higher level, the maximum dimension of the pores in the surface direction is preferably not greater than, 1,000 μm. From the standpoint of enhancement of absorbency of aqueous liquid to a higher level, the maximum dimension of the pores in the surface direction is preferably not smaller than 0.1 μm.

The average dimension of the pores in the porous resin film in the thickness direction is normally from 0.01 μm to 50 μm, preferably from 0.1 μm to 10 μm. From the standpoint of enhancement of absorbency of aqueous liquid, the dimension of the pores in the thickness direction is preferably greater, but the upper limit of the pore dimension in the thickness direction can be predetermined depending on the purpose to provide the film with a proper mechanical strength.

<Formulation and Preparation Method of Porous Resin Film>

The porous resin film of the invention comprises in combination a thermoplastic resin, an inorganic and/or organic finely divided powder, and a surface treating agent as constituent components.

Examples of the thermoplastic resin to be used in the porous resin film of the invention include ethylene-based resin such as high density polyethylene, middle density polyethylene and low density polyethylene, propylene-based resin, polyolefin-based resin such as polymethyl-1-pentene and ethylene-cyclic olefin copolymer, polyamide-based resin such as nylon-6, nylon-6,6, nylon-6,10 and nylon-6,12, thermoplastic polyester-based resin such as polyethylene terephthalate, copolymer thereof, polyethylene naphthalate and aliphatic polyester, and thermoplastic resin such as polycarbonate, atactic polystyrene, syndiotactic polystyrene and polyphenylene sulfide. Two or more of these thermoplastic resins may be used in admixture.

Preferred among these thermoplastic resins is an ethylene-based resin or a polyolefin-based resin such as propylene-based resin, more preferably propylene-based resin from the standpoint of chemical resistance, low specific gravity, cost, etc. Examples of the propylene-based resin include isotactic polymer or syndiotactic polymer obtained by homopolymerization of propylene. Alternatively, a copolymer comprising as main component a polypropylene having various stereoregularities obtained by the copolymerization of α-olefin such as ethylene, 1-butene, 1-hexene, 1-heptene and 4-methyl-1-pentene with propylene may be used. The copolymer may be in the form of binary or ternary or higher system or may be either a random copolymer or a block copolymer. The propylene-based resin preferably comprises a resin having a melting point lower than that of propylene hompolymer incorporated therein in an amount of from 2 to 25% by weight. Examples of such a resin having a low melting point include high density or low density polyethylene.

The organic or inorganic finely divided powder to be used in the porous resin film of the invention is not specifically limited, but specific examples of the organic or inorganic finely divided powder will be given below.

Examples of the inorganic finely divided powder include heavy calcium carbonate, light calcium carbonate, agglomerated light calcium carbonate, silica having various pore volumes, zeolitet clay, talc, titanium oxide, barium sulfate, zinc oxide, magnesium oxide, diatomaceous earth, silicon oxide, composite inorganic finely divided powder having a hydroxyl group-containing inorganic finely divided powder such as silica as nucleus surrounded by an aluminum oxide or hydroxide, etc.

The organic finely divided powder is selected from non-compatible organic finely divided powders having a higher melting point or glass transition point than that of the thermoplastic resin to be used in the porous resin film of the invention for the purpose of forming pores. Specific examples of the organic finely divided powder include polyethylene terephthalate, polybutylene terephthalate, polyamide, polycarbonate, polyethylene. naphthalate, polystyrene, polymer or copolymer of acrylic acid ester or methacrylic acid ester, melamine resin, polyethylene sulfite, polyimide, polyethyl ether ketone, polyphenylene sulfide, homopolymer of cyclic olefin, copolymer of cyclic olefin with ethylene, etc. An organic finely divided powder having a melting point of from 120° C. to 300° C. or a glass transition temperature of from 120° C. to 280° C. is preferably used.

Preferred among inorganic finely divided powder and organic finely divided powder is inorganic finely divided powder because it generates little amount of heat when combusted. Among these inorganic finely divided powders, heavy calcium carbonate, clay and diatomaceous earth are preferably used because they are inexpensive and have good pore-forming properties if the film is stretched.

The average particle diameter of the inorganic finely divided powder or organic finely divided powder is preferably from 0.01 $\mu$m to 20 $\mu$m, more preferably from 0.1 $\mu$m to 10 $\mu$m, even more preferably from 2 $\mu$m to 10 $\mu$m. The average particle diameter of the inorganic finely divided powder or organic finely divided powder is preferably not smaller than 0.01 $\mu$m from the standpoint of ease of mixing with the thermoplastic resin. In the case where the porous resin film is stretched to form pores in the interior thereof, enhancing the absorbency thereof, the average particle diameter of the inorganic finely divided powder or organic finely divided powder is preferably not greater than 20 $\mu$m from the standpoint of difficulty in the occurrence of troubles such as sheet breakage and deterioration of strength of surface layer during stretching.

The particle diameter of the surface-treated inorganic and/or organic finely divided powder can be determined by the particle diameter corresponding to 50% of cumulation of particle diameter (50% cumulative particle diameter) measured by a particle diameter meter, eg., laser diffraction type particle diameter meter "Microtrack" (produced by NIKKISO CO., LTD.). The particle diameter of finely divided powder dispersed in the thermoplastic resin by melt kneading and dispersion can be determined as an average value by measuring at least 20 particles on the section of the porous resin film under an electron microscope.

The inorganic and/or organic finely divided powder used in the invention may have various specific surface areas or oil absorptions. The specific surface area of the inorganic and/or organic finely divided powder is measured by BET method and is, by way of example, preferably from 0.1 to 1,000 $m^2/g$, more preferably from 0.2 to 500 $m^2/g$.

When an inorganic or organic finely divided powder having a great specific surface area is used, it tends to improve the absorption of an aqueous solvent or ink. By way of example, the oil absorption (JIS K5101-1991, etc.) of the inorganic or organic finely divided powder is from 1 to 300 ml/100 g, preferably from 10 to 200 ml/100 g.

The finely divided powder used in the porous resin film of the invention may be singly selected and used one among those described above or selected or used in combination two or more among those described above. In the case where two or more of inorganic or organic finely divided powders are used in combination, an organic finely divided powder and an inorganic finely divided powder may be used in combination.

The treatment (A) of the invention is a copolymer of diallylamine salt or alkyl diallylamine salt (a1) with nonionic hydrophilic vinyl monomer (a2).

The term "salt" constituting the treatment (A) as used herein is meant to indicate one formed by an anion selected from the group consisting of chloride ion, bromide ion, sulfuric acid ion, nitric acid ion, methylsulfuric acid ion, ethylsulfuric acid ion and methanesulfonic acid ion.

Specific examples of the diallylamine salt or alkyl diallylamine salt (a1) include diallylamine salt, alkyl diallylamine salt and dialkyl diallylamine salt having from 1 to 4 carbon atoms (e.g., methyl diallylamine salt, ethyl diallylamine salt, dimethyl diallylamine salt), chloride, bromide, methosulfate and ethosulfate of methacryloyloxy ethyl trimethyl ammonium, acryloyloxy ethyl trimethyl ammonium, methacryloyloxy ethyl dimethyl ethyl ammonium and acryloyloxy ethyl dimethyl ethyl ammonium, and quaternary ammonium salt obtained by alkylating N,N-dimethylaminoethyl methacrylate or N,N-dimethylaminoethyl acrylate with an epoxy compound such as epichlorohydrin, glycidol and glycidyltrimethyl ammonium chloride. Preferred among these compounds are diallylamine salt, methyl diallylamine salt, and dimethyl diallylamine salt.

Specific examples of the nonionic hydrophilic vinyl monomer (a2) include acrylamide, methacrylamide, N-vinylformamide, N-vinylacetamide, N-vinylpyrrolidone, 2-hydroxyethyl methacrylate, 2-hydroxyethyl acrylate, 2-hydroxypropyl (meth)acrylate, 3-hydroxypropyl (meth) acrylate, methyl ester (meth)acrylate, ethyl ester (meth) acrylate, and butyl ester (meth)acrylate. Preferred among these compounds are acrylamide, and methacrylamide.

The copolymerization ratio of (a1) to (a2) is arbitrary. The proportion of salt (at) is preferably from 10 to 99 mol-%, more preferably from 50 to 97 mol-%, even more preferably from 65 to 95 mol-%. The proportion of monomer (a2) is preferably from 1 to 90 mol-%, more preferably from 3 to 50 mol-%, even more preferably from 3 to 35 mol-%.

The treatment (A) can be obtained by the reaction of the aforementioned monomer mixture in an aqueous solvent in the presence of an initiator such as ammonium persulfate and 2,2-azobis(2-amidinopropane)dihydrochloride at a temperature of from 40° C. to 100° C., e.g., from 50° C. to 80° C., for 2 hours to 24 hours. The polymer can be produced by the method described in Japanese Patent Laid-Open No. 1993-263010, Japanese Patent Laid-Open No. 1995-300568, etc. The polymer can be used to accomplish the aim of the invention. Some of those polymers disclosed in Japanese Patent 1982-48340, Japanese Patent Laid-Open No. 1988-235377, etc. can be used as well.

Preferred among these compounds are copolymer of hydrochloride or sulfate of diallylamine or diallyl dimethylamine with methacrylamide or acrylamide.

The molecular weight of the polymer is normally from 0.05 to 3, preferably from 0.1 to 0.7, particularly from 0.1 to 0.45 as calculated in terms of intrinsic viscosity at 25° C. in a 1N aqueous solution of sodium chloride.

The molecular weight of the polymer is from about 5,000 to 950,000, preferably from 10,000 to 150,000, even more preferably from 10,000 to 80,000 as calculated in terms of weight-average molecular weight measured by gel permeation chromatography (GPC).

The surface treating agent falling within the aforementioned scope greatly enhances the absorption of an aqueous solvent or aqueous ink by the porous resin film of the invention.

The anionic surface treating agent (B) has an anionic functional group in its molecule. Specific examples of such a compound will be given below. These compounds are properly selected to exert the effect of the invention. The term "anionic surface treating agent (B)" will be hereinafter abbreviated as "treatment (B)". The term "salt" as used in the treatment (B) indicates lithium salt, sodium salt, potassium salt, calcium salt, magnesium salt, primary to quaternary ammonium salt or primary to quaternary phosphonium salt. Preferred salts are lithium salt, sodium salt, potassium salt, and quaternary ammonium salt, more preferably sodium salt or potassium salt.

Specific examples of the treatment (B) include (B1) sulfonic acid salt having a hydrocarbon group having from 4 to 40 carbon atoms, (B2) phosphoric acid ester salt having a hydrocarbon group having from 4 to 40 carbon atoms, phosphoric acid mono- or diester salt of higher alcohol having from 4 to 40 carbon atoms, phosphoric acid ester salt of ethylene oxide adduct of higher alcohol having from 4 to 40 carbon atoms, and (B3) alkylbetaine or alkylsulfobetaine having a hydrocarbon group having from 4 to 40 carbon atoms.

(B1) Examples of the sulfonic acid salt having a hydrocarbon group having from 4 to 40 carbon atoms include sulfonate and sulfoalkane carboxylate having a hydrocarbon group having a straight-chain, branched or cyclic structure having from 4 to 40, preferably from 8 to 20 carbon atoms. Specific examples of these compounds include alkylbenzenesulfonaic acid salt and naphthalenesulfonic acid salt having from 4 to 40, preferably from 8 to 20 carbon atoms, alkylnaphthalenesulfonic acid salt having a straight-chain, branched or cyclic structure having from 4 to 30, preferably from 8 to 20 carbon atoms, monosulfonate or disulfonate of diphenylether or biphenyl having an alkyl group having a straight-chain or branched structure having from 1 to 30, preferably from 8 to 20 carbon atoms, alkanesulfonic acid salt having a straight-chain, branched or cyclic structure having from 1 to 30, preferably from 8 to 20 carbon atoms, alkylsulfuric acid ester salt having from 1 to 30, preferably from 8 to 20 carbon atoms, sulfoalkanecarboxylic acid ester salt, sulfonic acid salt of alkylene oxide adduct of alkyl alcohol having from 8 to 30, preferably from 10 to 20 carbon atoms, etc.

Specific examples of these compounds include alkanesulfonic acid or aromatic sulfonic acid, i.e., octanesulfonic acid salt, dodecanesulfonic acid salt, hexadecanesulfonic acid salt, octadecanesulfonic acid salt, 1- or 2-dodecylbenzenesulfonic acid salt, 1- or 2-hexadecylbenzenesulfonic acid salt, 1- or 2-octadecylbenzenesulfonic acid salt, various isomers of naphthalenesulfonic acid salt, various isomers of dodecylnaphthalenesulfonic acid salt, β-naphthalenesulfonic acid-formalin condensate salt, various isomers of octylbiphenylsulfonic acid salt, dodecylbiphenylsulfonic acid salt, various isomers of dodecylphenoxybenzenesulfonic acid salt, dodecyldiphenylether disulfonic acid salt, dodecyl lignin sulfonic acid salt, alkylsulfuric acid ester salt, i.e., dodecylsulfuric acid salt, hexadecylsulfuric acid salt, sulfoalkanecarboxylic acid salt, i.e., sulfosuccinic acid dialkylester the alkyl moiety of which has a straight-chain, branched or cyclic structure having from 1 to 30, preferably from 4 to 20 carbon atoms, e.g., sulfosuccinic acid di(2-ethylhexyl) salt, N-methyl-N-(2-sulfoethyl)alkylamide salt (alkyl group has from 1 to 30, preferably from 12 to 18 carbon atoms) (e.g., amide compound derived from N-methyltaurin and oleic acid), 2-sulfoethylester salt of carboxylic acid having from 1 to 30, preferably from 10 to 18 carbon atoms, laurylsulfuric acid triethanolamine, laurylsulfuric acid ammonium, polyoxyethylene laurylsulfuric acid salt, polyoxyethylene cetylsulfuric acid salt, sulfonate of alkylene oxide adduct of alkyl alcohol having from 8 to 30, preferably from 10 to 20 carbon atoms (e.g., sulfuric acid ester salt of ethylene oxide adduct of lauryl alcohol, sulfuric acid ester salt of ethylene oxide adduct of cetyl alcohol, sulfuric acid ester salt of ethylene oxide adduct of stearyl alcohol), etc.

(B2) Phosphoric acid mono- or diester salt or phosphoric acid triester having a hydrocarbon group having a straight-chain, branched or cyclic structure having from 4 to 40, preferably from 8 to 20 carbon atoms. Specific examples of such a compound include phosphoric acid dodecyl disodium salt or dipotassium salt, phosphoric acid hexadecyl disodium salt or dipotassium salt, phosphoric acid didodecyl disodium salt or dipotassium salt, phosphoric acid dihexadecyl sodium salt or potassium salt, phosphoric acid triester of ethylene oxide adduct of dodecyl alcohol, etc.

(B3) Alkylbetaine or alkylsulfobetaine having a hydrocarbon group having from 4 to 40, preferably from 10 to 20 carbon atoms. Specific examples of such a compound include lauryl dimethylbetaine, stearyl dimethylbetaine, dodecyl dimethyl(3-sulfopropyl)ammonium inner salt, cetyl dimethyl(3-sulfopropyl)ammonium inner salt, stearyl dimethyl(3-sulfopropyl)ammonium inner salt, 2-octyl-N-carboxymethyl-N-hydroxyethylimidazolinium betaine, 2-lauryl-N-carboxymethyl-N-hydroxyethylimidazolinium betaine, etc.

Preferred among these compounds is (B1). Preferred among the (B1) compounds are alkanesulfonic acid salt having from 10 to 20 carbon atoms, aromatic sulfonic acid salt having from 10 to 20 carbon atoms, sulfuric acid ester salt of alkylene oxide adduct of alkyl alcohol having from 10 to 20 carbon atoms.

(Process for Surface Treatment of Inorganic and/or Organic Finely Divided Powder)

In the invention, the treatment (A) is attached to the surface of the inorganic and/or organic finely divided powder so that the finely divided powder is subjected to surface treatment at a first step. Subsequently, the treatment (B) is attached to the surface of the finely divided powder so that the finely divided powder is subjected to surface treatment. The process for the surface treatment of the finely divided powder may be various known processes without any special restriction. The mixing machine used and the mixing temperature and time may be properly predetermined according to the properties and physical properties of the components used. The L/D (axial length/axial diameter) ratio of the mixing machine, the shape, shear rate and specific energy of the agitating blade, the retention time, the processing time, the processing temperature, etc. may be predetermined according to the properties of the components used.

Specific examples of the first step of surface treatment include:

(I) Process which comprises adding the aforementioned treatment (A) in the form of powder, liquid, paste or solution or dispersion in water or an organic solvent or in the form of solution or dispersion having a proper concentration obtained by removing part of solvent or no solvent from the treatment (A), if it has been prepared using a solvent, to the finely divided powder, and then stirring the mixture at a low or high speed to attach the treatment (A) to the periphery of the finely divided powder;

(II) Process which comprises adding the treatment (A) to a finely divided powder suspended in water or a solvent such as organic solvent, or adding a finely divided powder to a solution of the treatment (A) in a solvent, mixing the two components, removing the solvent from the mixture, and then drying the mixture to attach the treatment to the periphery of the finely divided powder;

(III) Process which comprises adding the treatment (A) to a finely divided powder before or during grinding, if the finely divided powder is prepared by a dry or wet grinding method, so that the treatment (A) is attached to the periphery of the finely divided powder during grinding;

(IV) Process which comprises adding a necessary amount of the treatment (A) to a part of the finely divided powder to be used in a concentration higher than the required concentration to prepare a master batch made of finely divided powder and treatment (A), mixing the master batch with the balance of the finely divided powder to attach the master batch to the periphery of the finely divided powder, and then mixing the finely divided powder with a thermoplastic resin;

(V) Process which comprises adding the treatment (A) in the form of powder, liquid, paste or solution or dispersion in a solvent to a finely divided powder before, during or after polymerization, if the finely divided powder is an organic finely divided powder prepared by polymerization, to attach the treatment (A) to the periphery of the organic finely divided powder; and (VI) Process which, if the finely divided powder is an organic fine divided powder obtained by dispersing a finely divided powder in a thermoplastic resin continuous phase during melt kneading, comprises adding the treatment (A) to a thermoplastic resin and an undispersed organic fine divided powder or a mixture of thermoplastic resin and undispersed fine divided powder during melt kneading so that the treatment (A) is attached to the periphery of the organic fine divided powder while the organic fine divided powder is being finely dispersed during melt kneading.

Among these surface-treated finely divided powders, the inorganic finely divided powder produced by wet grinding, e.g., particulate calcium carbonate, can be obtained by wet-grinding a heavy particulate calcium carbonate having a particle diameter as relatively great as from 10 $\mu$m to 50 $\mu$m in an aqueous medium in the presence of the treatment (A) in a required amount based on 100 parts by weight thereof to reduce the particle diameter thereof to a predetermined value, drying the particulate calcium carbonate, treating the particulate calcium carbonate with the treatment (B) in an aqueous medium, and then drying the material.

As calcium carbonate which is a raw material, a heavy particulate calcium carbonate obtained by dry grinding, a particulate calcium carbonate classified and riddled, or the like is used. The particulate calcium carbonate is dispersed in an aqueous medium.

The heavy calcium carbonate is wet-ground in the presence of the aforementioned treatment (A). Aqueous medium is added to calcium carbonate in an amount such that the weight ratio of calcium carbonate to aqueous medium (preferably water) is from 70/30 to 30/70, preferably from 60/40 to 40/60. To the mixture is then added a cationic copolymer dispersant in an amount of from 0.01 to 10 parts by weight, preferably from 0.1 to 5 parts by weight as calculated in terms of solid content per 100 parts by weight of calcium carbonate. The mixture is then wet-ground by an ordinary method. Alternatively, calcium carbonate may be mixed with a previously prepared aqueous medium having the treatment (A) dissolved therein in the aforementioned amount, and then wetground by an ordinary method.

The wet grinding may be effected batchwise or continuously. A mill comprising a grinding machine such as sand mill, attritor and ball mill or the like is preferably used. When calcium carbonate is thus wet-ground, a particulate calcium carbonate having an average particle diameter of from 2 $\mu$m to 20 $\mu$m, preferably 2.2 $\mu$m to 5 $\mu$m can be obtained.

Subsequently, the material thus wet-ground is dried, Drying may be preceded by classification that allows the removal of coarse grains having about 350 mesh. Drying can be accomplished by any known method such as hot air drying and powder spray drying, preferably by medium flow drying.

Medium flow drying is a method which comprises supplying a slurried material into a particulate medium (fluidized bed) which has been fluidized by a hot air (80° C. to 150° C.) in a drying column so that the slurried material thus supplied is dispersed in the fluidized bed while being attached to the surface of actively fluidized medium particles in the form of film, causing the various materials to be dried under the drying action by hot air.

The medium flow drying can be easily carried out by means of a medium flow dryer "Media Slurry Dryer" produced by Nara Machinery Co., Ltd. The use of this medium flow drying method makes it possible to effect drying and grinding of agglomerated particles (removal of primary particles) at the same time to advantage.

When the wet-ground slurry thus obtained is then subjected to medium flow drying, calcium carbonate having an extremely small content of coarse particles can be obtained. However, the medium flow drying may be followed by grinding and classification of particles by desired method. On the other hand, in the case where the wet-ground material is dried by an ordinary hot air drying method instead of medium flow drying, the cake thus obtained is preferably further subjected to grinding and classification by desired method.

The dried cake of wet-ground material thus obtained can easily collapse to form desired particulate calcium carbonate. Accordingly, it is not particularly necessary that a step of grinding the dried cake be provided. The particulate calcium carbonate thus obtained is further treated with the treatment (B) in an aqueous medium.

In the case where the treatment (A) in the form of solution or dispersion in a solvent or paste is mixed with an inorganic and/or organic finely divided powder, the mixing temperature may be properly predetermined according to the properties of the finely divided powder or surface treating agent By way of example, the mixing temperature is from room temperature to 120° C., and if drying is needed, from 40° C. to 120° C., preferably from 80° C. to 120° C. Alternatively, vacuum drying or drying with dried air or hot air may be employed as necessary.

Processes for the treatment with the treatment (B) include a process involving the treatment with the treatment (B) after the aforementioned wet grinding, a process which comprises the treatment of the finely divided powder in the form of dispersion in an aqueous solvent (preferably water) with the treatment (A) and then with the treatment (B), a process which comprises adding the treatment (B) to the finely divided powder surface-treated with the treatment (A) while being mixed or melt-kneaded with the thermoplastic resin so that it is treated, etc.

Preferred among these processes are the process involving the treatment with the treatment (B) after the wet grinding, the process which comprises the treatment of the finely divided powder in the form of dispersion in water with the treatment (A) and then with the treatment (B), and the process which comprises adding the treatment (B) to the finely divided powder surface-treated with the treatment (A) while being mixed or melt-kneaded with the thermoplastic resin so that it is treated.

(Proportion of Constituent Components)

Referring to preferred proportion of components constituting the porous resin film of the invention, the content of the thermoplastic resin is from 30 to 90% by weight, and the content of the surface-treated inorganic and/or organic finely divided powder is from 10 to 70% by weight.

The content of the thermoplastic resin is more preferably from 30 to 60% by weight, even more preferably from 35 to 55% by weight. From the standpoint of further enhancement of the strength of the porous resin film, it is not smaller than 30 parts by weight, and in order to further enhance the absorption of aqueous solvent or ink, it is not greater than 90% by weight.

The amount of the surface-treated inorganic and/or organic finely divided powder is by way of example from 10 to 70% by weight. The amount of the inorganic finely divided powder is preferably from 40 to 70% by weight, more preferably from 45 to 65% by weight. In order to increase pores, it is preferred that the amount of the finely divided powder be greater. However, for the purpose of enhancing the surface strength of the porous resin film to a higher level, the amount of the finely divided powder is preferably not greater than 70% by weight. Most organic finely divided powders have a small specific gravity. The amount of the organic finely divided powder is preferably from 10 to 50% by weight, more preferably from 15 to 40% by weight.

The amount of the treatment (A) used varies with the purpose of the porous resin film. In practice, however, the amount of the treatment (A) used is from 0.01 to 10 parts by weight, preferably from 0.04 to 5 parts by weight, more preferably from 0.07 to 2 parts by weight based on 100 parts by weight of the inorganic and/or organic finely divided powder. From the standpoint of enhancement of absorption of aqueous solvent or aqueous ink, the amount of the treatment (A) used is preferably not smaller than 0.01 parts by weight. When the amount of the treatment (A) used exceeds 10 parts by weight, the effect of the treatment (A) reaches the upper limit.

The amount of the treatment (B) used varies with the purpose of the porous resin film. In practice, however, the amount of the treatment (B) used is from 0.01 to 10 parts by weight, preferably from 0.05 to 5 parts by weight, more preferably from 0.5 to 4 parts by weight based on 100 parts by weight of the inorganic and/or organic finely divided powder. From the standpoint of enhancement of absorption of aqueous solvent or aqueous ink, the amount of the treatment (B) used is preferably not smaller than 0.01 parts by weight. When the amount of the treatment (B) used exceeds 10 parts by weight, the effect of the treatment (B) reaches the upper limit.

(Arbitrary Components)

When these finely divided powders are kneaded with the thermoplastic resin, a dispersant, an oxidation inhibitor, a compatibilizer, a fire retardant, an ultraviolet stabilizer, a coloring pigment, etc. may be added as necessary. In the case where the porous resin film of the invention is used as a durable material, an oxidation inhibitor, ultraviolet stabilizer, etc. are preferably added.

Various methods may be used for mixing the components constituting the porous resin film of the invention. Thus, the method for mixing the components constituting the porous resin film of the invention is not specifically limited. The mixing temperature and time are properly predetermined according to the properties of the components used. Examples of the mixing method include a method which comprises mixing the components while being dissolved or dispersed in a solvent, and a melt-kneading method. The melt-kneading method gives a good production efficiency. A method which comprises mixing a thermoplastic resin in the form of powder or pellet, an inorganic and/or organic finely divided powder surface-treated with the treatment (A), and the treatment (B) in a Henschel mixer, ribbon blender, super mixer or the like, melt-kneading the mixture in a single-screw or twin-screw kneader, extruding the mixture into a strand form, and then cutting the strand to form pellets, or a method which comprises extruding the mixture through a strand die into water, and then cutting the material with a rotary blade mounted on the forward end of the die may be employed. As the single-screw or twin-screw kneader to be used there may be selected one having various L/D (axial length/axial diameter) ratios, shear rate, specific energies, retention times, temperatures, etc. according to the properties of the components used.

The porous resin film and recording medium of the invention can be prepared by using various methods known to those skilled in the art in combination. Any porous resin film or recording medium prepared by these known methods can be included in the scope of the invention so far as it comprises a porous resin film satisfying the requirements of the invention.

To prepare a porous resin film of the invention having a liquid absorption capacity of not smaller than 0.5 $ml/m^2$, any of the various film preparation techniques or a combination thereof may be used. For example, a film stretching method utilizing the formation of pores by stretching, a rolling method or calendering method involving the formation of pores during rolling, a foaming method using a foaming agent, a method using pore-containing particles, a solvent extraction method, a method involving dissolution and extraction of mixed components, etc. may be used. Preferred among these methods is the film stretching method.

In the case where the film stretching method is employed, it is not necessarily required that only the porous resin film of the invention be stretched. For example, in the case where it is tried to finally prepare a (laminated) recording medium having the porous resin film of the invention formed on a substrate layer, an unstretched porous resin film and a substrate layer may be laminated, and then together stretched. When these layers are previously laminated before combined stretching, it gives simplicity and reduced cost as compared with the case where these layers are separately stretched before being laminated. In addition, this method makes it easier to control the pores formed in the porous resin film of the invention and the substrate layer. In particular, when the laminate is used as a recording medium, it is preferably controlled such that the porous resin film has more pores than the substrate layer to effectively act as a layer capable of improving ink absorbency.

The thermoplastic resin film forming the substrate layer may have a single layer structure, a two-layer structure consisting of a core layer and a surface layer, a three-layer structure comprising a surface layer provided on the both surfaces of a core layer or a multi-layer structure comprising other resin film layers interposed between the core layer and the surface layer and may be stretched at least monoaxially. In the case where the multi-layer structure film is stretched, the three-layer structure film may be stretched monoaxially all at the three layers, stretched monoaxially both at the surface layer and the core layer and biaxially at the back layer, stretched monoaxially at the surface layer, biaxially at the core layer and monoaxially at the back layer, stretched biaxially at the surface layer and monoaxially both at the core layer and the back layer, stretched monoaxially at the surface layer and biaxially both at the core layer and the back layer, stretched biaxially both at the surface layer and the core layer and monoaxially at the back layer or stretched biaxially all at the three layers. In the case of a structure having more layers, the number of stretching axes is arbitrarily combined.

As the thermoplastic resin, inorganic finely divided powder and organic finely divided powder used in the substrate layer, materials similar to those used in the aforementioned porous resin film may be used.

In the case where the thermoplastic resin layer is a single-layer polyolefin-based resin film comprising an inorganic and/or organic finely divided powder incorporated therein, the thermoplastic resin film layer normally comprises a polyolefin-based resin and an inorganic and/or organic finely divided powder in an amount of from 40 to 99.5% by weight and from 0.5 to 60% by weight, preferably from 50 to 97% by weight and from 3 to 50% by weight, respectively.

In the case where the thermoplastic resin film has a multi-layer structure and the core layer and surface layer comprise an inorganic and/or organic finely divided powder incorporated therein, the core layer normally comprises a polyolefin-based resin and an inorganic and/or organic finely divided powder incorporated therein in an amount of from 40 to 99.5% by weight and from 0.5 to 60% by weight, preferably from 50 to 97% by weight and from 3 to 50% by weight, respectively, and the surface layer normally comprises a polyolefin-based resin and an inorganic and/or organic finely divided powder incorporated therein in an amount of from 25 to 100% by weight and from 0 to 75% by weight, preferably from 30 to 97% by weight and from 3 to 70% by weight, respectively.

When the amount of the inorganic and/or organic finely divided powder incorporated in the core layer having a single-layer or multi-layer structure exceeds 60% by weight, the resin film which has been longitudinally stretched can easily break during crosswise stretching. When the amount of the inorganic and/or organic finely divided powder to be incorporated in the surface layer exceeds 75% by weight, the surface layer which has been crosswise stretched has a lowered surface strength and the surface layer can easily break due to mechanical in use to disadvantage.

For the stretching, various known methods can be employed The stretching can be effected at a temperature of not lower than the glass transition point of the thermoplastic resin used in the case of amorphous resin or at a temperature suitable for thermoplastic resin from not lower than the glass transition point of the amorphous portion to not higher than the melting point of the crystalline portion in the case of crystalline resin. In some detail, the stretching can be accomplished by longitudinal stretching utilizing the difference in circumferential speed between rolls, rolling, crosswise stretching using a tenter oven, inflation stretching using a mandrel on tube-like film, simultaneous biaxial stretching using a tenter oven and a linear motor in combination or the like.

The draw ratio is not specifically limited and is properly predetermined taking into account the purpose of the porous resin film of the invention and the properties of the thermoplastic resin. For example, in the case where a propylene homopolymer or copolymer is used as the thermoplastic resin, the draw ratio is from about 1.2 to 12, preferably from 2 to 10 for monoaxial stretching or from 1.5 to 60, preferably from 10 to 50 as calculated in terms of area for biaxial stretching. In the case where other thermoplastic resins are used, the draw ratio is from 1.2 to 10, preferably 2 to 7 for monoaxial stretching or from 1.5 to 20, preferably from 4 to 12 as calculated in terms of area for biaxial stretching.

The film may be subjected to heat treatment at a high temperature as necessary. The stretching temperature is from 2 to 60° C. lower than the melting point of the thermoplastic resin used, and the stretching speed is preferably from 10 to 350 m/min.

The thickness of the porous resin film of the invention is not specifically limited. For example, it is not smaller than 5 μm, preferably not smaller than 25 μm, more preferably not smaller than 30 μm from the standpoint of further enhancement of absorption of aqueous solvent or aqueous ink. The upper limit of the thickness of the porous resin film is properly predetermined by the required absorption of aqueous liquid. By way of example, it is not greater than 1,000 μm, preferably not greater than 500 μm, more preferably not greater than 300 μm.

The porous resin film of the invention can be used as it is or may be laminated on another thermoplastic resin, laminated paper, pulp paper, nonwoven cloth, cloth, etc. before use. Examples of the another thermoplastic resin film on which the porous resin film of the invention is laminated include transparent or opaque films such as polyester film, polyamide film and polyolefin film.

In particular, a proper functional layer as described in the examples below can be formed on the porous resin film of the invention to form a recording medium. For example, the porous resin film of the invention can be formed as a surface layer on a substrate layer made of a thermoplastic resin film to prepare a recording medium. The recording medium comprising the porous resin film of the invention as a surface layer is useful particularly as a recording medium for ink jet recording. The kind of the substrate layer is not specifically limited, but a film comprising a polypropylene-based resin and an inorganic finely divided powder incorporated therein may be exemplified.

The recording medium thus formed by laminating the porous resin film of the invention with other films may have a total thickness of, e.g., from 50 μm to 1 mm.

The aforementioned porous resin film or a laminate comprising same may be subjected to surface oxidation treatment as necessary. There are some cases where surface oxidation treatment makes it possible to enhance the hydrophilicity or absorbency of the surface of the film or enhance the coatability of the film with an ink-fixing agent or ink-receptive layer or the adhesivity of the film with the substrate. As the surface oxidation treatment there may be used one selected from corona discharge treatment, flame treatment, plasma treatment, glow discharge treatment and ozone treatment, preferably corona treatment or flame treatment, more preferably corona treatment.

The amount of treatment is from 600 to 12,000 J/m$^2$ (from 10 to 200 W·min/m$^2$), preferably from 1,200 to 9,000 J/m$^2$ (from 20 to 180 W·min/$m^2$) in the case of corona treatment. In order to sufficiently exert the effect of corona discharge treatment, it is not smaller than 600 J/$m^2$ (10 W·min/$m^2$). When the amount of treatment exceeds 12,000 J/$m^2$ (200 W·min/$m^2$), the effect of treatment reaches the upper limit. Thus, the amount of treatment suffices if it is not greater than 12,000 J/$m^2$ (200 W·min/$m^2$). The amount of treatment is from 8,000 to 200,000 J/$m^2$, preferably from 20,000 to 100,000 J/$m^2$ in the case of flame treatment In order to exert a definite effect of flame treatment, the amount of treatment is not smaller than 8,000 J/$m^2$. When the amount of treatment exceeds 200,000 J/$m^2$, the effect of treatment reaches the upper limit. Thus, the amount of treatment suffices if it is not greater than 200,000 J/$m^2$.

In the case where the porous resin film of the invention is used as a recording medium, the porous resin film of the invention may have an ink-receptive layer for fixing a dye or pigment colorant formed on the surface thereof. The combination of such a colorant-fixing layer or ink-receptive layer with the porous resin film of the invention having a good absorption of aqueous solvent makes it possible to reduce the occurrence of running, enhance the absorbency and reduce the thickness of the colorant-fixing layer or ink-receptive layer.

The colorant-fixing layer acts to round the ink dot, thereby providing a sharper image as well as preventing the flow of colorant due to water or moisture. Accordingly, when the porous resin film of the invention is used as an ink jet recording medium, the colorant-fixing layer is particularly useful.

(Ink-Receptive Layer)

In the invention, an ink-receptive layer is provided to obtain water resistance in addition to ink absorbency. Preferably, an ink-receptive layer having a surface gloss (as measured at 60° according to JIS Z-8741) of not smaller than 40% is provided to obtain a high gloss.

The ink-receptive layer may have either a single-layer structure or a multi-layer structure consisting of two or more layers. In the case of multi-layer structure, the Various layers may have the same or different formulations. In order to form a multi-layer structure, two or more layers may be coated at once or successively.

<Inorganic Filler>

The ink-receptive layer comprises an inorganic filler having an average particle diameter of not greater than 350 nm and a binder resin incorporated therein in an amount of from 70 to 95% by weight and from 5 to 30% by weight, respectively, for the purpose of enhancing ink absorbency and realizing a high gloss.

When an inorganic filler having an average particle diameter of not smaller than 350 nm is used, the resulting ink-receptive layer exhibits a drastically lowered surface gloss, which is undesirable.

Examples of the inorganic filler to be used in the invention include colloidal silica, colloidal calcium carbonate, aluminum oxide, amorphous silica, pearl necklace-like colloidal silica, fibrous aluminum oxide, tabular aluminum oxide, alumina, alumina hydrate, etc.

Amorphous silica is preferred among the aforementioned inorganic fillers from the standpoint of ink jet printing ink absorbency or because of low cost. Also preferred among the aforementioned inorganic fillers is alumina or alumina hydrate because it has a positive charge on the surface of particle to fix the ink jet printing ink fairly.

In particular, to obtain a high gloss ink-receptive layer, amorphous silica obtained by agglomerating primary particles having an average diameter of from 1 to 10 nm is preferred.

An amorphous silica comprises agglomerated primary particles having an average diameter of from 1 to 50 nm. An amorphous silica having a primary particle diameter of from 1 to 10 nm is preferably used to enhance ink absorbency.

When an amorphous silica having a primary particle diameter of not smaller than 10 nm is used in the ink-receptive layer, the resulting ink-receptive layer exhibits a drastic deterioration of gloss and ink absorbency, which is undesirable. The reason why an amorphous silica falling within the scope of the invention exhibits a high performance is unknown. However, this is presumably because the amorphous silica having a primary particle diameter of from 1 to 10 nm has a high gloss as well as has an increased gap between primary particles and hence an enhanced ink absorbency.

Processes for preparing amorphous silica can be roughly divided into two groups, i.e., dry process and wet process. In the invention, silica prepared by any process can be used so far as it is an amorphous silica having a primary particle diameter of from 1 to 10 nm and an average particle diameter of not greater than 350 nm.

Alternatively, in the invention, an amorphous silica having an average particle diameter of not greater than 350 nm obtained by crushing a commercially available amorphous silica having an average particle diameter of from 2 to 10 $\mu$m can be used. The method for crushing amorphous silica is not specifically limited. However, mechanical grinding using a grinder is preferably employed from the standpoint of uniformity in quality and because it allows grinding at a reduced cost. Specific examples of the grinder include ultrasonic grinding, jet mill, sand grinder, roller mill, high speed rotary mill, etc.

The amorphous silica used in the invention is preferably subjected to cationic treatment on the surface thereof to enhance the fixability of an ink jet printing ink, which is anionic.

Cationic treatment is treatment for covering the surface of silica with a cationic chemical during grinding or preparation of silica. Examples of such a cationic chemical include inorganic metal salt, cationic coupling agent, cationic polymer, etc.

Specific examples of the inorganic metal salt include hydrates of inorganic metal oxide such as aluminum oxide hydrate, zirconium oxide hydrate and tin oxide hydrate, water-soluble inorganic metal salt such as aluminum hydroxide, aluminum sulfate, aluminum chloride, aluminum acetate, aluminum nitrate, zirconium sulfate, zirconium chloride and tin chloride, etc.

Specific examples of the cationic coupling agent include cationic silane coupling agent such as amino group-containing silane coupling agent and quaternary ammonium group-containing silane coupling agent, cationic zirconium coupling agent such as amino group-containing zirconium coupling agent and quaternary ammonium group-containing zirconium coupling agent, cationic titanium coupling agent such as amino group-containing titanium coupling agent and quaternary ammonium group-containing titanium coupling agent, and cationic glycidyl coupling agent such as amino group-containing glycidyl coupling agent and quaternary ammonium group-containing glycidyl coupling agent.

Specific examples of the cationic polymer include polyalkylene polyamine such as polyethyleneimine and polypropylene polyamine, derivative thereof, amino group-containing acrylic polymer, quaternary ammonium group-containing acrylic polymer, amino group-containing polyvinyl alcohol, quaternary ammonium group-containing polyvinyl alcohol, etc.

The average particle diameter and primary particle diameter of the inorganic filler used in the ink-receptive layer of the invention can be measured by the same apparatus used in the measurement of the inorganic finely divided powder or organic finely divided powder in the aforementioned porous substrate.

Specific examples of alumina include α-alumina, β-alumina, γ-alumina, δ-alumina, η-alumina, θ-alumina, etc. From the standpoint of ink absorbency and gloss, δ-alumina is preferred.

Specific examples of the alumina hydrate include alumina hydrate having a pseudo-boehmite structure (pseudo-boehmite), alumina hydrate having an amorphous structure (amorphous alumina hydrate), etc. Pseudo-boehmite is preferred from the standpoint of ink absorbency and gloss.

<Binder Resin>

In the ink-receptive layer of the invention, a binder resin is used as an adhesive.

In the invention, the ink-receptive layer comprises a binder resin incorporated therein as an adhesive in addition to the inorganic filler. Referring to the mixing proportion of inorganic filler and binder resin, the proportion of the organic filler and the binder resin are preferably from 70 to 95% by weight and from 5 to 30% by weight, respectively.

When the proportion of the inorganic filler exceeds 95% by weight, the resulting ink-receptive layer exhibits a drastically reduced adhesivity to the porous resin film. On the contrary, when the proportion of the inorganic filler falls below 70% by weight, the resulting ink-receptive layer exhibits a drastically reduced ink absorbency.

Specific examples of the binder resin employable herein include water-soluble resins such as polyvinyl alcohol, derivative thereof, polyvinyl pyrrolidone, polyacrylamide, hydroxyethyl cellulose, casein and starch, and water-insoluble resins such as urethane-based resin, ester-based resin, epoxy-based resin, ethylene-based resin, ethylene-vinyl acetate copolymer resin, vinyl acetate-based resin, vinyl chloride-based resin, vinyl chloride-vinyl acetate-based copolymer resin, vinylidene chloride-based resin, vinyl chloride-vinylidene copolymer resin, acrylic acid-based resin, methacrylic acid-based resin, polybutyral-based resin, silicon resin, nitrocellulose resin, styrene-acryl copolymer resin, styrene-butadiene-based copolymer resin and acrylonitrile-butadiene-based copolymer resin. The aforementioned water-soluble resin may be used in the form of aqueous solution, and the aforementioned water-insoluble resin may be used in the form of solution, emulsion or latex.

Preferred among the aforementioned binder resins is polyvinyl alcohol from the standpoint of compatibility with the inorganic filler or ink absorbency. In particular, from the standpoint of strength of coat film, a polyvinyl alcohol having a polymerization degree of not smaller than 3,000 and a saponification degree of from 80% to 95% is preferred. In the invention, a crosslinking agent is preferably used in an amount of from 1 to 20% by weight based on the amount of the ink-receptive layer to enhance the water resistance of the binder resin. Specific examples of the crosslinking agent include urea-formaldehyde resin, melamine-formaldehyde resin, polyamide polyurea-formaldehyde resin, glyoxal, epoxy-based crosslinking agent, polyisocyanate resin, boric acid, borax, various borates, etc.

In addition, in the invention, the ink-receptive layer preferably comprises an ink-fixing agent incorporated therein in an amount of from 1 to 20% by weight based on the amount of the ink-receptive layer to improve the ink fixability. Examples of the ink-fixing agent include inorganic metal salt, cationic coupling agent, cationic polymer, etc.

Specific examples of the inorganic metal salt, cationic coupling agent and cationic polymer include those described with reference to the cationic chemical used in the cationic treatment of the aforementioned amorphous silica.

The ink-receptive layer of the invention may also comprise various auxiliaries such as dispersant, thickening agent, antifoaming agent, preservative, ultraviolet absorber, oxidation inhibitor and surfactant, which are normally used in coated paper as necessary.

The coated amount of the ink-receptive layer of the invention is properly predetermined according to the liquid absorption capacity of the porous resin film used as a support. This coated amount is preferably from 5 to 30 g/m$^2$. When the coated amount of the ink-receptive layer falls below 5 g/m$^2$, the resulting ink-receptive layer lacks gloss, oozing properties and water resistance. On the other hand, when the coated amount of the ink-receptive layer exceeds 30 g/m$^2$, the resulting ink-receptive layer exhibits a satisfactory ink absorbency but exhibits deteriorated surface strength.

(Top Coat Layer)

In the invention, for the purpose of improving gloss and surface fretting abrasion resistance, it is preferred that a top coat layer having a gloss (as measured at 60° according to JIS Z-8741) of not smaller than 50% be provided on the ink-receptive layer.

The top coat layer of the invention preferably comprises an inorganic filler and a binder resin incorporated therein in an amount of from 70 to 95% by weight and from 5 to 30% by weight, respectively. As the inorganic filler and binder resin there may be used the same filler and binder as the inorganic filler and binder resin used in the ink-receptive layer.

The top coat layer preferably comprises a cationic ink-fixing agent incorporated therein in an amount of from 1 to 20% by weight for the purpose of enhancing ink fixability. As the ink-fixing agent there may be used the same fixing agent as the ink-fixing agent used in the aforementioned ink-receptive layer.

The coated amount of the top coat layer of the invention is properly predetermined according to the porous resin film or ink-receptive layer but is from 0.1 to 5.0 g/m$^2$, preferably from 0.5 to 3.0 g/m$^2$ When the coated amount of the top coat layer falls below 0.1 g/m$^2$, the effect of the top coat layer is not sufficiently exerted. On the other hand, when the coated amount of the top coat layer exceeds 5.0 g/m$^2$, the effect of the top coat layer is saturated.

The top coat layer of the invention may comprise various auxiliaries such as dispersant, thickening agent, antifoaming agent, preservative, ultraviolet absorber, oxidation inhibitor and surfactant which are normally used in coated paper as necessary.

(Coating Method)

The method for coating the aforementioned ink-receptive layer and top coat layer on the porous resin film can be properly selected from known methods. Examples of the coating method include blade coating method, rod bar coating method, roll coating method, air knife coating method, spray coating method, gravure coating method, curtain coating method, die coating method, comma coating method, etc.

The porous resin film or laminate of the invention may be subjected to printing other than ink jet printing depending on the purpose. The kind and process of printing are not specifically limited. For example, printing can be carried out by a known printing method such as gravure printing all using an ink having a pigment dispersed in a known vehicle, aqueous flexographic printing, silk screen printing, melt heat transfer printing and sublimation heat transfer printing. Alternatively, printing can be carried out by metallization, gloss printing, mat printing or the like. The pattern to be printed may be properly selected from natural pattern such as animal, scenery, lattice and polka dots and abstract pattern.

The porous resin film of the invention is also suited for applications requiring the absorption of aqueous liquid other than printing purposes. For example, the porous resin film of the invention can be used as an adhesive label comprising an aqueous adhesive, label paper to be stuck on vessels such as bottles and cans, water-absorbing film, wall paper, surface decorative paper for veneer board and plasterboard, film for preventing the production of water drop, drip preventive wrapping paper for food, coaster, paper for working, colored paper used for making figures by folding, water-retaining sheet, soil drying preventive sheet, concrete drying aid material, drying agent, dehumidifier or the like.

EXAMPLES

The invention will be further described hereinafter in the following examples, comparative examples and test examples. Proper changes can be made in the materials, added amount, proportion, operation, etc. described in the following examples so far as they don't depart from the spirit of the invention. Accordingly, the scope of the invention is not limited to the specific examples described hereinafter.

Porous resin films of the invention, recording media comprising same and recording media comprising comparative resin films were prepared according to the following procedures.

[Preparation of Treatment A]

Reference Example 1

In a reaction vessel equipped with a reflux condenser, a thermometer, a dropping funnel, an agitator and a gas inlet pipe were charged 500 parts by weight (60% by weight) of diallylamine hydrochloride, 21 parts by weight (40% by weight) of acrylamide and 90 parts by weight of water. The temperature in the system was then raised to 80° C. while a nitrogen gas was being introduced thereinto. A polymerization initiator and 30 parts (25% by weight) of ammonium persulfate were then added dropwise to the reaction mixture with stirring in 4 hours. The reaction mixture was allowed to undergo reaction at the same temperature for 1 hour to obtain a viscous light yellow liquid material.

50 g of the product was measured out, and then poured into 500 ml of acetone to produce a white precipitate. The precipitate was withdrawn by filtration, thoroughly washed with 100 ml of acetone twice, and then dried in vacuo to obtain a cationic polymer surface treating agent in the form of white solid (abbr.: A1) (yield: 95%). The polymer thus obtained exhibited an intrinsic viscosity of 0.33 dl/g at 25 C. as measured in a 1N aqueous solution of sodium chloride and a weight-average molecular weight of 55,000 as determined by GPC.

Reference Example 2

In a reaction vessel equipped with a reflux condenser, a thermometer, a dropping funnel, an agitator and a gas inlet pipe were charged 500 parts by weight (60% by weight) of diallylamine hydrochloride, 45 parts by weight (40% by weight) of acrylamide and 190 parts by weight of water. The temperature in the system was then raised to 80° C. while a nitrogen gas was being introduced thereinto. A polymerization initiator and 30 parts (25% by weight) of ammonium persulfate were then added dropwise to the reaction mixture with stirring in 4 hours. The reaction mixture was allowed to undergo reaction at the same temperature for 1 hour to obtain a viscous light yellow liquid material.

50 g of the product was measured out, and then poured into 500 ml of acetone to produce a white precipitate. The precipitate was withdrawn by filtration, thoroughly washed with 100 ml of acetone twice, and then dried in vacuo to obtain a cationic polymer surface treating agent in the form of white solid (abbr.: A2) (yield: 96%). The polymer thus obtained exhibited an intrinsic viscosity of 0.38 dl/g at 25° C. as measured in a 1N aqueous solution of sodium chloride and a weight-average molecular weight of 64,000 as determined by GrC.

[Preparation of Surface-Treated Heavy Calcium Carbonate]

Preparation Example 1

40 parts by weight of a heavy calcium carbonate (average particle diameter; 3 $\mu$m; specific surface area: 1.8 $m^2/g$; oil absorption: 31 ml/100 g as measured according to JISK5101-1991, abbreviation: tankaru 1) as a finely divided powder and 60% by weight of water were thoroughly stirred in admixture to form a slurry. To the slurry was then added the treatment (A1) prepared in Reference Example 1 in an amount of 0.1 parts by weight based on 100 parts by weight of the heavy calcium carbonate. The mixture was then stirred. To the mixture was then added a 2 wt-% aqueous solution of Anstex SAS (trade name of a product mainly composed of mixture of sodium alkanesulfonate having 14 carbon atoms and sodium alkanesulfonate having 16 carbon atoms produced by TOHO CHEMICAL INDUSTRY CO., LTD.; abbr.: B1) in an amount of 50 parts by weight (2.5 parts by weight based on 100 parts by weight of heavy calcium carbonate as calculated in terms of solid content). The mixture was then stirred to form a slurry which was then dried by a medium flow dryer MSD-200 produced by NARA MACHINERY CO, LTD. to obtain a surface-treated heavy calcium carbonate. The surface-treated heavy calcium carbonate thus obtained is abbreviated as SF1.

The particle diameter of the calcium carbonate powder used in the examples of the specification is 50% cumulative particle diameter measured by a laser diffraction type particle measuring instrument "Microtrack" (trade name, produced by NIKKISO CO., LTD.).

Preparation Example 2

A surface-treated calcium carbonate (abbreviation: SF2) was obtained in the same manner as in Preparation Example 1 except that a 5 wt-% aqueous solution of dodecylbenzenesulfonic acid (abbr.: B2) were used in an amount of 20 parts by weight (2.5 parts by weight based on 100 parts by weight of heavy calcium carbonate as calculated in terms of solid content) instead of Anstex SAS.

Preparation Example 3

A surface-treated calcium carbonate (abbreviation: SF3) was obtained in the same manner as in Preparation Example 1 except that a 2 wt-% aqueous solution of sodium stearyl polyethylene ether sulfonate (abbr: B3) were used in an amount of 50 parts by weight (2.5 parts by weight based on 100 parts by weight of heavy calcium carbonate as calculated in terms of solid content) instead of Anstex SAS.

Preparation Example 4

A coarse particulate heavy calcium carbonate having an average particle diameter of 30 $\mu$m (dry-ground product produced by Nihon Cement Co., Ltd.) and water were mixed at a ratio of 40/60. To the mixture was then added the surface treating agent (A1) prepared in Reference Example 1 in an amount of 0.08 parts by weight based on 100 parts by weight of the heavy calcium carbonate. The mixture was then wet-ground with glass beads having a diameter of 1.5 mm at a percent packing of 170% and a peripheral speed of 10 m/sec. by means of a table attritor type medium stirring mill.

Subsequently, to the mixture was added a 5 wt-% aqueous solution of dodecylbenzenesulfonic acid (abbr.: B2) in an amount of 20 parts by weight (2 parts by weight based on 100 parts by weight of heavy calcium carbonate as calculated in terms of solid content). The mixture was then stirred. Subsequently, the mixture was subjected to classification through a 350-mesh screen. The slurry which had passed through the screen was then dried by a medium flow dryer MSD-200 produced by NARA MACHINERY CO., LTD. The calcium carbonate thus obtained was measured for average particle diameter by means of Microtrack [produced by NIKKISO CO., LTD.]. The results were 2.2 $\mu$m (abbr.: SF4)

Preparation Example 5

40% by weight of a heavy calcium carbonate (average particle diameter: 3 $\mu$m; specific surface area: 1.8 $m^2/g$; oil absorption: 31 ml/100 g as measured according to JXS-K5101-1991; abbreviation: tankaru 1) as a finely divided powder and 60% by weight of water were thoroughly stirred in admixture to form a slurry. To the slurry was then added the treatment (A1) prepared in Reference Example 1 in an amount of 0.2 parts by weight based on 100 parts by weight of the heavy calcium carbonate. The mixture was then stirred. The slurry was then dried by a medium flow dryer MSD-200 produced by NARA MACHINERY CO., LTD. to obtain a surface-treated heavy calcium carbonate. The surface-treated heavy calcium carbonate thus obtained is abbreviated as SF5.

Preparation Example 6

40% by weight of a heavy calcium carbonate (average particle diameter: 3 $\mu$m; specific surface area: 1.8 $m^2/g$; oil absorption: 31 ml/100 g as measured according to JIS-K5101-1991; abbreviation: tankaru 1) as a finely divided powder and 60% by weight of water were thoroughly stirred in admixture to form a slurry. To the slurry was then added the treatment (A2) prepared in Reference Example 1 in an amount of 0.1 parts by weight based on 100 parts by weight of the heavy calcium carbonate. The mixture was then stirred. The slurry was then dried by a medium flow dryer MSD-200 produced by NARA MACHINERY CO., LTD. to obtain a surface-treated heavy calcium carbonate. The surfacetreated heavy calcium carbonate thus obtained is abbreviated as SF6.

Example 1

<Preparation and Longitudinal Stretching of Substrate Layer>

A mixture of 75% by weight of a polypropylene having a melt flow rate (MFR; temperature: 230° C.; load; 2.16 kg) of 1 g/10 min. and 5% by weight of a high density polyethylene having a melt flow rate (MFR; temperature: 190° C.; load: 2.16 kg) of 8 g/10 min. were mixed with 20% by weight of calcium carbonate having an average particle diameter of 3 $\mu$m to obtain a composition [a]. The composition [a] was kneaded by means of an extruder the temperature of which had been set at 250° C., and then extruded into strands which were then cut to form pellets. The pellets of the composition [a] were then extruded through a T-die connected to the extruder the temperature of which had been set at 250° C. into a sheet which was then cooled by a cooling machine to obtain an unstretched sheet. Subsequently, the unstretched sheet was heated to a temperature of 145° C., and then longitudinally stretched at a draw ratio of 4.5 to obtain a stretched sheet.

In the melt kneading of the resin component or the mixture thereof with the finely divided powder in the present example, BHT (4-methyl-2,6-di-t-butylphenol) and Irganox 1010 (trade name of phenol-based oxidation inhibitor produced by Ciba Geigy Inc.) were added to the resin component and the finely divided powder in an amount of 0.2 parts by weight and 0.1 parts by weight, respectively, based on 100 parts by weight of the total weight of the resin component and the finely divided powder.

<Formation of Surface Porous Resin Film>

Separately, 40% by weight of a polypropylene (abbreviation: PP1) having MFR of 20 g/10 minutes and 60% by weight of the surface-treated calcium carbonate (abbreviation: SF1) were thoroughly mixed in the form of powder, and then extruded through a biaxial kneader which had been set at a temperature of 240° C. into strands which were then cut to prepare pellets (composition [b]).

The composition [b] was then extruded through a T-die connected to the extruder which had been set at a temperature of 230° C. (temperature a) into a sheet. The sheet thus obtained was then laminated on both surfaces of the sheet which had been stretched at a draw ratio of 4.5 in the aforementioned manner, cooled to a temperature of 50° C. (temperature b), and then stretched at a draw ratio of 8.5 in the crosswise direction by means of a tenter at an elevated temperature of 154° C. (temperature c). Thereafter, the laminate was annealed at a temperature of 155° C. (temperature d), cooled to a temperature of 55° C. (temperature e), and then slit at the edge thereof to obtain a laminate comprising a porous resin film having a total thickness of 130 $\mu$m having a three-layer structure (surface absorption layer [b]/substrate layer [a]/back absorption layer [b]: thickness 55 $\mu$m/40 $\mu$m/35 $\mu$m).

The laminates of the examples and comparative examples were then evaluated on the surface absorption layer.

These laminates were evaluated in the following manner.

<Evaluation>

(1) Liquid Absorption Capacity

The liquid absorption capacity of the aforementioned porous resin film at 2 seconds was measured by means of a liquid absorbency testing machine produced by Kumagai Riki Kogyo K.K. according to "Japan TAPPI No. 51-87" (JAPAN TAPPI, paper pulp testing method No. 51-87; Bristow Method). The measurement solvent was obtained by mixing 70% by weight of water and 30% by weight of ethylene glycol, and then dissolving malachite green in the mixed solvent in an amount of 2 parts by weight based on 100 parts by weight of the mixed solvent.

(2) Average Contact Angle of Porous Resin Film with Respect to Water and Difference between Maximum Value and Minimum Value Thereof The contact angle of the surface of the aforementioned porous resin film was determined by dropping purified water onto the surface of the film, and then measuring the surface of the film for contact angle by means of a contact angle meter (Type CA-D, produced by KYOWA INTERFACE SCIENCE CORPORATION LIMITED) after 1 minute. This measurement was effected 10 times (the specimen was replaced by an unmeasured film which had not been wet with purified water every measurement), and the average value of the ten measurements of contact angle and the difference between the maximum value and the minimum value of contact angle were then determined.

(3) Confirmation of Presence of Surface Pores and Measurement of Number and Dimension of Surface Pores The aforementioned porous resin film was cut to sample a portion out of the film to confirm that pores were present in the surface and section of the film. An arbitrary portion was cut out of the porous resin film sample. The sample was then vacuum-metallized with gold or gold-palladium on the surface to be observed. The sample was then observed at a magnification power of 500 under a Type S-2400 scanning electron microscope produced by Hitachi Ltd. to confirm the presence of pores in the surface of the film and the presence of an inorganic finely divided powder in the interior or end of the majority of all pores, i.e., at least 50% of all pores. Further, the electron microscope image was outputted onto paper or taken in photograph on which the number of pores in the surface of the film was then counted. As a result, the number of pores was about $3.5\times10^9/m^2$. Subsequently, the measurements of the aforementioned 89 pores were averaged. As a result, the major axis was 14.5 $\mu$m, the minor axis was 3.4 $\mu$m, and the average diameter was 9 $\mu$m. In the case where two pores are connected to both sides of a finely divided particle or upper and lower sides of a finely divided particle, respectively, the two pores were collectively regarded as a pore assuming that pores are formed with the finely divided particle as a center.

(4) Confirmation of Presence of Internal Pores and Measurement of Internal Porosity The porous resin film was embedded in an epoxy resin which was then solidified, cut by a microtome so that sections were formed in the direction parallel to the thickness direction and in the direction perpendicular to the surface of the film, respectively, metallized with gold-palladium on the sections, and then observed on the sections at a magnification power of 1,000 to confirm the presence of internal pores and the presence of a finely divided powder in at least some of the internal pores.

The total thickness and basis weight ($g/m^2$) of the porous resin film were measured. Subsequently, the surface absorption layer was peeled off the laminate at a predetermined area. The thickness and basis weight of the remaining film were then measured. From these differences were then determined the thickness and basis weight ($g/m^2$) of the porous resin film layer, respectively. The density ($\rho$) of the absorption layer was then calculated by dividing the basis weight by the thickness Subsequently, the composition [b] was formed into a press sheet having a thickness of 1 mm at a temperature of 230° C. The density ($\rho_0$) of the press sheet was then measured. The porosity of the porous resin film was then calculated by the following equation.

$$\%\ \text{Porosity}=100(\rho_0-\rho)/\rho_0$$

(5) Ink Absorbency

A color chart for evaluation (50% printed monochromatic color and 100% printed monochromatic color on 2 cm×2 cm area, 200% printed polychromatic color on 2 cm×2 cm area) was prepared, and printing was then made on the various recording media on its porous resin film as surface layer with pigment inks (yellow, magenta, cyan, black) using an ink jet printer (Type JP2115, produced by GRAPHTEC CORPORATION). Thereafter, a filter paper was pressed onto the printed area at a predetermined interval of time to observe to see if the ink returned to the filter paper. The time at which the ink no longer returns to the filter paper was recorded. The ink absorbency was then evaluated according to the following criterion.

6: Time in which the ink no longer returns to the filter paper is shortly after printing;

5: Time in which the ink no longer returns to the filter paper is not more than 1 minute;

4: Time in which the ink no longer returns to the filter paper is from more than 1 minute to not more than 2 minutes;

3: Time in which the ink no longer returns to the filter paper is from more than 2 minutes to not more than 3 minutes;

2: Time in which the ink no longer returns to the filter paper is from more than 3 minutes to not more than 4 minutes;

1: Time in which the ink no longer returns to the filter paper is from more than 4 minutes to not more than 5 minutes; and 0: The ink still returns to the filter paper and doesn't dry even after more than 5 minutes (Evaluation of Density Unevenness)

The porous resin film which had absorbed the ink was visually observed for density unevenness, and then evaluated according to the following criterion.

4: No density unevenness;

3: Little density unevenness;

2: Some density unevenness; and

1: Remarkable density unevenness (Evaluation of Running)

The porous resin film which had absorbed the ink was visually observed for running, and then evaluated according to the following criterion.

4: No running, sharp image;

3: Little running, little difficulty in recognition of image;

2: Some running, some difficulty in recognition of image; and

1: Remarkable running, disabled to use (Evaluation of Surface Unevenness After Printing)

The porous resin film on which printing had been made was allowed to stand in a room for 1 hour, visually observed for the occurrence of surface unevenness (roughness), and then evaluated according to the following criterion.

3: No unevenness, flat surface, little or no change from before printing;

2: Little unevenness; and

1: Remarkable unevenness (Evaluation of Water Resistance)

The printed sample which had been prepared under the same conditions as in the aforementioned evaluation of ink absorbency was dipped in a sufficient amount of tap water (temperature: 25° C.) for 4 hours, air-dried on the surface thereof, visually observed for the degree of ink retention, and then evaluated according to the following criterion.

3: Percent ink retention is from 80% to 100%;

2: Percent ink retention is from 50% to 80%; and

1: Percent ink retention is from 0% to 50%

The results of the aforementioned various tests and evaluations are set forth in Table 1.

Comparative Example 1

A laminated film having a porous resin film provided on the surface thereof was prepared and evaluated in the same manner as in Example except that the surface-treated calcium carbonate SF1 was replaced by the heavy calcium carbonate (average particle diameter: 3 $\mu$m; specific surface area: 1.8 $m^2/g$; oil absorption: 31 ml/100 g as measured according to JIS-K5101-1991; abbreviation: tankaru 1) used in Experiment Example 1 which had been not subjected to surface treatment. The results of evaluation are set forth in Table 1.

Comparative Example 2

A laminated film having a porous resin film provided on the surface thereof was prepared and evaluated in the same manner as in Example except that the surface-treated calcium carbonate SF1 was replaced by the heavy calcium carbonate (average particle diameter: 3 μm; specific surface area: 1.8 $m^2/g$; oil absorption; 31 ml/100 g as measured according to JIS-K5101-1991; abbreviation: tankaru 1) used in Experiment Example 1 and as a surface treating agent there was used stearic acid in an amount of 4 parts by weight based on 100 parts by weight of calcium carbonate. The results of evaluation are set forth in Table 1.

Example 2

A laminated film having a porous resin film provided on the surface thereof was prepared and evaluated in the same manner as in Example 1 except that the surface-treated heavy calcium carbonate SF1 was replaced by the heavy calcium carbonate SF2The results of evaluation are set forth in Table 1.

Example 3

A laminated film having a porous resin film provided on the surface thereof was prepared and evaluated in the same manner as in Example 1 except that the surface-treated heavy calcium carbonate SF1 was replaced by the heavy calcium carbonate SF3. The results of evaluation are set forth in Table 1.

Example 4

A laminated film having a porous resin film provided on the surface thereof was prepared and evaluated in the same manner as in Example 1 except that the surface-treated heavy calcium carbonate SF1 was replaced by the heavy calcium carbonate SF4. The results of evaluation are set forth in Table 1.

Example 5

A laminated film having a porous resin film provided on the surface thereof was prepared and evaluated in the same manner as in Example 1 except that the surface-treated heavy calcium carbonate SF1 was replaced by the heavy calcium carbonate SF5 and Anstex SAS was added in an amount of 3.5 parts by weight based on 100 parts by weight of calcium carbonate during mixing with polypropylene. The results of evaluation are set forth in Table 1.

Example 6

A laminated film having a porous resin film provided on the surface thereof was prepared and evaluated in the same manner as in Example 1 except that the surface-treated heavy calcium carbonate SF1 was replaced by the heavy calcium carbonate SF6 and sodium benzenesulfonate was added in an amount of 3 parts by weight based on 100 parts by weight of calcium carbonate during mixing with polypropylene. The results of evaluation are set forth in Table 1.

Example 7

A laminated film having a porous resin film provided on the surface thereof was prepared and evaluated in the same manner as in Example 1 except that the mixing proportion and forming conditions were as set forth in Table 1. The results of evaluation are set forth in Table 1. (part 1).

TABLE 1

| | | Unit | Example 1 | Comparative Example 1 | Comparative Example 2 | Example 2 | Example 3 | Example 4 | Example 5 | Example 6 | Example 7 |
|---|---|---|---|---|---|---|---|---|---|---|---|
| Constituent component | Kind of thermoplastic resin | — | PP1 | PP1 | PP1 | PP1 | PPI | PP1 | PP1 | PP1 | PP1 |
| | Mixing proportion of thermoplastic resin | wt - % | 40 | 40 | 40 | 40 | 40 | 40 | 40 | 40 | 40 |
| | Kind of surface-treated finely divided powder | — | SF1 | Untreated | Untreated | SF2 | SF3 | SF4 | SF5 | SF6 | SF6 |
| | Mixing proportion of surface-treated finely divided powder | wt - % | 60 | Untreated 60 | Untreated 60 | 60 | 60 | 60 | 60 | 60 | 55 |
| | Kind of surface treating agent | — | A1 + B1 | — | Stearic acid | A1 + B2 | A1 + B3 | A1 + B1 | A1 + B1 | A2 + B2 | A1 + B2 |
| Forming conditions | Temperature a | ° C. | 230 | 230 | 230 | 230 | 230 | 230 | 230 | 230 | 230 |
| | Temperature b | ° C. | 50 | 50 | 50 | 50 | 50 | 50 | 50 | 50 | 50 |
| | Temperature c | ° C. | 154 | 154 | 154 | 154 | 154 | 154 | 154 | 154 | 154 |
| | Temperature d | ° C. | 155 | 155 | 155 | 155 | 155 | 155 | 155 | 155 | 155 |
| | Temperature e | ° C. | 55 | 55 | 55 | 55 | 55 | 55 | 55 | 55 | 55 |
| Results of evaluation of film | Total thickness of film | μm | 130 | 135 | 134 | 132 | 138 | 135 | 139 | 135 | 125 |
| | Thickness of porous resin film | μm | 45 | 45 | 42 | 50 | 58 | 49 | 53 | 50 | 44 |
| | Thickness of substrate layer | μm | 50 | 55 | 56 | 50 | 50 | 53 | 52 | 53 | 51 |

TABLE 1-continued

| | Unit | Example 1 | Comparative Example 1 | Comparative Example 2 | Example 2 | Example 3 | Example 4 | Example 5 | Example 6 | Example 7 |
|---|---|---|---|---|---|---|---|---|---|---|
| Liquid absorption capacity (2 sec.) | m1/m$^2$ | 11.7 | 0 | 0 | 13.1 | 15.6 | 12.8 | 13.1 | 12.9 | 10.5 |
| Surface gloss | % | 22 | 23 | 25 | 25 | 23 | 30 | 22 | 26 | 22 |
| Average surface contact angle with water | ° | 93 | 114 | 115 | 87 | 84 | 89 | 90 | 84 | 90 |
| Difference between maximum value and minimum value of contact angle with water | ° | 2 | 2 | 3 | 2 | 3 | 3 | 2 | 4 | 2 |
| Internal porosity | % | 54 | 55 | 57 | 57 | 55 | 60 | 54 | 57 | 53 |
| Number of surface pores | /m$^2$ | 3.5E+9 | 3.8E+9 | 1.9E+9 | 9.8E+8 | 1.2E+9 | 7.5E+9 | 1.5E+9 | 1.3E+9 | 9.1E+8 |
| Average diameter of surface pores | $\mu$m | 9 | 8 | 9 | 10 | 8 | 6 | 10 | 9 | 9 |
| Surface pores having finely divided powder in interior thereof or at end thereof | Visually observed | Not smaller than half | Not smaller than half | Not smaller than half | Not smaller than half | Not smaller than half | Not smaller than half | Not smaller than half | Not smaller than half | Not smaller than half |
| Internal pores having finely divided powder in interior therof or at end thereot | Visually observed | Observed | Observed | Observed | Observed | Observed | Observed | Observed | Observed | Observed |
| Ink absorbency (monochromatic 50%) | Visually observed | 6 | 0 | 0 | 6 | 6 | 6 | 6 | 6 | 6 |
| Ink absorbency (monochromatic 100%) | Visually observed | 6 | 0 | 0 | 6 | 6 | 6 | 6 | 6 | 6 |
| Ink absorbency (polychromatic 200%) | Visually observed | 6 | 0 | 0 | 5 | 6 | 6 | 6 | 6 | 6 |
| Density unevenness | Visually observed | 4 | 1 | 1 | 3 | 4 | 4 | 4 | 4 | 4 |
| Running | Visually observed | 3 | 1 | 1 | 3 | 3 | 3 | 3 | 3 | 3 |
| Surface unevenness after printing | Visually observed | 3 | 3 | 3 | 3 | 3 | 3 | 3 | 3 | 3 |

Examples 8, 9

The laminates having a porous resin film provided on the surface thereof described in Examples 1 and 3 were each subjected to corona treatment on the surface thereof at a density of 3,600 J/m$^2$ (60 W·min/m$^2$). These laminates were each then evaluated in the same manner as in Example 1. The results of evaluation are set forth in Table 2.

Example 10

The porous resin film prepared in Example 1 was subjected to corona treatment at a density of 3,600 J/m$^2$ (60 W·min/m$^2$). Onto the porous resin film (on one surface thereof) was then coated a coating solution for ink-receptive layer having the following formulation in an amount of 5 g/m$^2$ as calculated in terms of solid content. The coated material was dried, and then subjected to smoothing by super calendering to obtain an ink jet recording paper.

Formulation of Coating Solution:

| | |
|---|---|
| Synthetic silica powder (Mizukasil) P-78D, produced by MIZUSAWA INDUSTRIAL CHEMICALS, LTD.) | 100 parts by weight |
| Polyvinyl alcohol (PVA-117, produced by KURARAY CO., LTD.) | 30 parts by weight |

-continued

| | |
|---|---|
| Polyamine polyamide epichlorohydrin adduct (WS-570, produced by JAPAN PMC CORPORATION) | 10 parts by weight |
| Sodium polyacrylate (reagent, produced by Wake Pure Chemical Industries, Ltd.) | 5 parts by weight |
| Water | 1,600 parts by weight |

The ink jet recording paper thus obtained was then evaluated in the same manner as in Example 1. The results of evaluation are set forth in Table 2.

Comparative Example 3

A commercially available pulp paper-based ink jet paper (Epson Superfine Paper MJA4SP1) was evaluated in the same manner as in Example 1. The results are set forth in Table 2.

TABLE 2

| | | Unit | Example 8 | Example 9 | Example 10 | Comparative Example 3 |
|---|---|---|---|---|---|---|
| Substrate/support | Kind of substrate or support | — | Example 1 | Example 3 | Example 1 | Pulp-based paper |
| | Kind of surface oxidation treatment | — | Corona treatment | Corona treatment | Corona treatment | |
| | Intensity of surface oxidation treatment | $J/m^2$ | 3,600 | 3,600 | 3,600 | |
| | Liquid absorption capacity after surface oxidation treatment | $m1/m^2$ | 12 | 16 | 12 | |
| | Contact angle with water after surface oxidation treatment | ° | 14 | 17 | 14 | |
| | Difference between maximum value and minimum value of contact angle with water after surface oxidation treatment | ° | 10 | 8 | 10 | |
| Coating | Solid content of ink-receptive layer | $g/m^2$ | — | — | 5 | |
| Results of evaluation | Ink dryability (monochromatic 50%) | Visually observed | 6 | 6 | 6 | 6 |
| | Ink dryability (monochromatic 100%) | Visually observed | 6 | 6 | 6 | 6 |
| | Ink dryability (polychroroatic 200%) | Visually observed | 6 | 6 | 6 | 6 |
| | Density unevenness | Visually observed | 4 | 4 | 4 | 4 |
| | Running | Visually observed | 3 | 3 | 4 | 4 |
| | Surface unevenness after printing | Visually observed | 3 | 3 | 3 | 1 |

Examples 11 to 15, Comparative Examples 4 to 9

The materials set forth in Table 3 were used in predetermined amounts, and then processed in the following manner to prepare an ink jet recording sheet.

An amorphous silica, a binder resin, a crosslinking agent, an ink-fixing agent, and water were mixed to prepare a coating solution for forming an ink-receptive layer. The coating solution was applied to the surface of the porous resin film by means of a mayor bar in a dried amount of 15 $g/m^2$, and then dried and solidified in a 110° C. oven for 5 minutes to form a receptive layer, thereby obtaining an ink jet recording paper. The ink jet recording paper was then evaluated for adaptability to ink jet printer in the same manner as for the porous resin film.

The formulation and the results of evaluation of surface gloss and adaptability to ink jet recording are set forth in Table 4.

Examples 16 to 18

The materials set forth in Table 3 were used in predetermined amounts, and then processed in the following manner to prepare an ink jet recording sheet.

An inorganic filler, a binder resin, an ink-fixing agent, and water were mixed to prepare a coating solution for top coat layer.

An ink-receptive layer was then formed on the porous resin film in the same manner as in Example 11. The coating solution for top coat layer was applied to the porous resin film by means of a mayor bar in a dried amount of 1.0 $g/m^2$, and then dried and solidified in a 110° C. oven for 1 minute to form a top coat layer, thereby obtaining an ink jet recording paper.

The formulation and the results of evaluation of surface gloss and adaptability to ink jet printer are set forth in Table 4.

TABLE 3

| Name of material | Contents |
|---|---|
| Amorphous silica 1 | Aqueous dispersion of particulate silica having a primary particle diameter of 7 nm and an average particle diameter of 300 nm obtained by grinding silica prepared by gel method (solid content: 20%) "Cyclojet 703A" (trade name, produced by Grace Japan Co., Ltd.) |
| Amorphous silica 2 | Aqueous dispersion of particulate silica having a primary particle diameter of 6 nm and an average particle diameter of 300 nm obtained by dispersing silica having an average particle diameter of 2.5 μm "Mizukasil P-73" (trade name, produced by MIZUSAWA INDUSTRIAL CHEMICALS, LTD.) prepared by gel method (solid content: 10%) by a sand grinder |
| Amorphous silica 3 | Aqueous dispersion of particulate cationically-treated silica having a primary particle diameter of 7 nm and an average particle diameter of 300 nm obtained by grinding silica prepared by gel method (solid content: 18%) "Cyclojet 703C" (trade name, produced by Grace Japan Co., Ltd.) |
| Amorphous silica 4 | Aqueous dispersion of silica having a primary particle diameter of 7 nm and an average particle diameter of 100 nm obtained by dispersing silica "Aerosil 300CF" (trade name, Nippon Aerosil Co., Ltd.) prepared by gas phase method by a sand grinder (solid content: 8%) |
| Amorphous silica 5 | Aqueous dispersion of silica having a primary particle diameter of 6 nm and an average particle diameter of 800 nm obtained by dispersing silica "Mizukasil P-73" (trade name, MIZUSAWA INDUSTRIAL CHEMICALS, LTD.) having an average particle diameter of 2.5 μm prepared by gel method by a sand grinder (solid content: 10%) |
| Amorphous silica 6 | Aqueous dispersion of silica having a primary particle diameter of 25 nm and an average particle diameter of 300 nm obtained by dispersing silica "Mizukasil P-526" (trade name, MIZUSAWA INDUSTRIAL CHEMICALS, LTD.) having an average particle diameter of 3.0 μm prepared by precipitation method by a sand grinder (solid content: 10%) |
| Colloidal silica 1 | "Snowtechs YL" (trade name, produced by Nissan Chemical Industries, Ltd.), which is an aqueous dispersion of spherical colloidal silica having an average particle diameter of 75 nm (solid content: 40%) |
| Binder resin | Aqueous solution of "Kuraray Poval PVA-235" (trade name, KURARAY CORP.) (solid content: 10%), which is a polvinyl alcohol having a polymerization degree of 3,500 and a saponification degree of 88% |
| Crosslinking agent 1 | Aqueous dispersion of a melamine-formaline resin (solid content: 80%) "Uramine P-6300" (trade name, produced by Mitsui Chemical Inc.) |
| Crosslinking agent 2 | 4% Aqueous dispersion of sodium tetraborate decahydrate (alias: borax, reagent grade, produced by Wako Pure Chemical Industries, Ltd.) |
| Ink-fixing agent 1 | Aqueous dispersion of cationic acryl polymer (solid content: 30%) "Sumirez Resin 1001" (trade name, produced by SUMITOMO CHEMICAL CO., LTD.) |
| Ink-fixing agent 2 | 10% Aqueous dispersion of aluminum chloride hexahydrate (reagent, produced by Wako Pure Chemical Industries, Ltd.) |

TABLE 4

| | | | Example 11 | Example 12 | Example 13 | Example 14 | Example 15 | Example 16 | Example 17 | Example 18 |
|---|---|---|---|---|---|---|---|---|---|---|
| Support | | | Example 3 | Example 3 | Example 3 | Example 3 | Example 3 | Example 3 | Example 3 | Example 3 |
| Ink-receptive layer | Amorphous silica 1 | | 76 | 76 | | | | 76 | 76 | 76 |
| | Amorphous silica 2 | | | | 76 | | | | | |
| | Amorphous silica 3 (cation) | | | | | 76 | | | | |
| | Amorphous silica 4 | | | | | | 76 | | | |
| | Amorphous silica 5 | | | | | | | | | |
| | Amorphous silica 6 | | | | | | | | | |
| | Binder resin | | 20 | 20 | 20 | 20 | 20 | 20 | 20 | 20 |
| | Crosslinking agent 1 | | 2 | 2 | 2 | 2 | | 2 | 2 | 2 |
| | Crosslinking agent 2 | | | | | | 2 | | | |
| | Ink-fixing agent 1 | | 2 | | 2 | 2 | | 2 | 2 | 2 |
| | Ink-fixing agent 2 | | | 2 | | | 2 | | | |
| | Coated amount (g/m$^2$) | | 15 | 15 | 15 | 15 | 15 | 15 | 15 | 15 |
| Top coat layer | Amorphous silica 1 | | | | | | | 90 | | |
| | Colloidal silica 1 | | | | | | | | 90 | 80 |
| | Binder resin | | | | | | | 10 | 10 | 10 |
| | Ink-fixing agent 2 | | | | | | | | | 10 |
| Results of evaluation of film | Surface gloss (%) | | 45 | 46 | 45 | 42 | 44 | 55 | 59 | 60 |
| | Ink dryability (polychromatic 200%) | Visually observed | 6 | 6 | 6 | 6 | 6 | 6 | 6 | 6 |
| | Density unevenness | Visually observed | 4 | 4 | 4 | 4 | 4 | 4 | 4 | 4 |
| | Running | Visually observed | 4 | 4 | 4 | 4 | 4 | 4 | 4 | 4 |
| | Water resistance | Visually observed | 3 | 3 | 3 | 3 | 3 | 3 | 3 | 3 |
| | Surface unevenness after printing | Visually observed | 3 | 3 | 3 | 3 | 3 | 3 | 3 | 3 |

| | | | Comparative Example 4 | Comparative Example 5 | Comparative Example 6 | Comparative Example 7 | Comparative Example 8 | Comparative Example 9 |
|---|---|---|---|---|---|---|---|---|
| Support | | | Comparative Example 2 | Example 3 | Example 3 | Example 3 | Example 3 | Example 3 |
| Ink-receptive layer | Amorphous silica 1 | | 80 | 76 | | | 60 | 97 |
| | Amorphous silica 2 | | | | | | | |
| | Amorphous silica 3 (cation) | | | | | | | |
| | Amorphous silica 4 | | | | | | | |
| | Amorphous silica 5 | | | | 76 | | | |
| | Amorphous silica 6 | | | | | 76 | | |
| | Binder resin | | 20 | 20 | 20 | 20 | 40 | 3 |
| | Crosslinking agent 1 | | | 2 | 2 | 2 | | |
| | Crosslinking agent 2 | | | | | | | |
| | Ink-fixing agent 1 | | | 2 | 2 | 2 | | |
| | Ink-fixing agent 2 | | | | | | | |
| | Coated amount (g/m$^2$) | | 15 | 15 | 15 | 15 | 15 | 15 |
| Top coat layer | Amorphous silica 1 | | | | | | | |
| | Colloidal silica 1 | | | | | | | |
| | Binder resin | | | | | | | |
| | Ink-fixing agent 2 | | | | | | | |
| Results of evaluation of film | Surface gloss (%) | | 47 | 37 | 15 | 18 | 44 | 3 |
| | Ink dryability (polychromatic 200%) | Visually observed | 6 | 0 | 6 | 6 | 6 | 6 |

TABLE 4-continued

| | | | | | | | |
|---|---|---|---|---|---|---|---|
| Density unevenness | Visually observed | 4 | 1 | 4 | 4 | 4 | 4 |
| Running | Visually observed | 4 | 1 | 4 | 4 | 4 | 4 |
| Water resistance | Visually observed | 1 | 1 | 1 | 1 | 1 | 1 |
| Surface unevenness after printing | Visually observed | 3 | 3 | 3 | 3 | 3 | 3 |

Examples 19 to 22, Comparative Examples 10 to 13

The materials set forth in Table 5 were used in predetermined amounts, and then processed in the following manner to prepare an ink jet recording sheet.

In some detail, alumina or alumina hydrate, and a binder resin were mixed to prepare a coating solution for forming an ink-receptive layer. The coating solution was applied to the surface of the porous resin film by means of a mayor bar in a dried amount of 15 g/m$^2$, and then dried and solidified in a 110° C. oven for 5 minutes to form a receptive layer, thereby obtaining an ink jet recording paper. The ink jet recording paper was then evaluated for adaptability to ink jet printer in the same manner as for the porous resin film.

The formulation and the results of evaluation of surface gloss and adaptability to ink jet recording are set forth in Table 6.

Examples 23, 24

The materials set forth in Table 5 were used in predetermined amounts, and then processed in the following manner to prepare an ink jet recording sheet.

An ink-receptive layer was formed on the porous resin film in the same manner as in Example 19. An inorganic filler and a binder resin were mixed to prepare a coating solution for top coat layer. The coating solution for top coat layer was then applied to ink-receptive layer by means of a mayor bar in a dried amount of 1.0 g/m$^2$, and then dried and solidified in a 110° C. oven for 1 minute to form a top coat layer, thereby obtaining an, ink jet recording paper.

The formulation and the results of evaluation of surface gloss and adaptability to ink jet printer are set forth in Table 6.

TABLE 5

| Name of material | Contents |
|---|---|
| Alumina 1 | Dispersion of "Aluminum Oxide C" (trade name, produced by Nippon Aerosil Co., Ltd.), which is δ-alumina having an average particle diameter of 20 nm, in a 80/20 (by weight) mixture of water and isopropyl alcohol obtained by dispersion using a homogenizer and a ultrasonic dispersing machine |

TABLE 5-continued

| Name of material | Contents |
|---|---|
| Alumina 2 | Dispersion of "AKP3000" (trade name, produced by SUMITOMO CHEMICAL CORPORATION), which is α-alumina having an average particle diameter of 550 nm, in a 80/20 (by weight) mixture of water and isopropyl alcohol obtained by dispersion using a homogenizer and a ultrasonic dispersing machine |
| Alumina hydrate 1 | Aqueous dispersion of fibrous pseudo boehmite having an average particle diameter of 100 nm (solid content: 7%) (Cataloid AS-3) (trade name, produced by CATALYSTS&CHEMICALS IND. CO., LTD.) |
| Alumina hydrate 2 | Aqueous dispersion of fibrous pseudo boehmite having an average particle diameter of 25 nm (solid content: 10%) (Cataloid AS-2) (trade name, produced by CATALYSTS&CHEMICALS IND. CO., LTD.) |
| Binder resin 1 | Aqueous solution of "Kuraray Poval PVA-235" (trade name, KURARAY CORP.) (solid content: 10%), which is a polvinyl alcohol having a polymerization degree of 3,500 and a saponification degree of 88% |
| Binder resin 2 | Aqueous solution of "Kuraray Poval PVA-124" (trade name, KURARAY CORP.) (solid content: 15%), which is a polvinyl alcohol having a polymerization degree of 2,400 and a saponification degree of 95% |
| Colloidal silica 1 | "Snowtechs YL" (trade name, produced by Nissan Chemical Industries, Ltd.), which is an aqueous dispersion of spherical colloidal silica having an average particle diameter of 70 nm (solid content: 40%) |
| Colloidal silica 2 | "Snowtechs PL-M" (trade name, produced by Nissan Chemical Industries, Ltd.), which is an aqueous dispersion of pearl necklace-like colloidal silica having an average particle diameter of 150 nm (solid content: 20%) |

TABLE 6

| | | | Example 19 | Example 20 | Example 21 | Example 22 | Example 23 | Example 24 | Comparative Example 10 | Comparative Example 11 | Comparative Example 12 | Comparative Example 13 |
|---|---|---|---|---|---|---|---|---|---|---|---|---|
| Support | | | Example 3 | Example 3 | Example 3 | Example 3 | Example 3 | Example 3 | Comparative Example 2 | Example 4 | Example 3 | Example 3 |
| Ink-receptive layer | Alumina 1 | | 80 | | | | 80 | 80 | 80 | | 60 | 97 |
| | Alumina 2 | | | | | | | | | 80 | | |
| | Alumina hydrate 1 | | | 90 | | | | | | | | |
| | Alumina hydrate 2 | | | | 90 | 90 | | | | | | |
| | Binder resin 1 | | 20 | 10 | 10 | | 20 | 20 | 20 | 20 | 40 | 3 |
| | Binder resin 2 | | | | | 10 | | | | | | |
| | Coated amount (g/m$^2$) | | 15 | 15 | 15 | 15 | 15 | 15 | 15 | 15 | 15 | 15 |
| Top coat layer | Colloidal silica 1 | | | | | | 90 | | | | | |
| | Colloidal silica 2 | | | | | | | 90 | | | | |
| | Binder resin 1 | | | | | | 10 | 10 | | | | |
| Results of evaluation if film | Surface gloss (%) | | 49 | 52 | 55 | 53 | 63 | 62 | 38 | 15 | 51 | 46 |
| | Ink dryability (polychromatic 200%) | Visually observed | 6 | 6 | 6 | 6 | 6 | 6 | 0 | 6 | 6 | 6 |
| | Density unevenness | Visually observed | 4 | 4 | 4 | 4 | 4 | 4 | 1 | 4 | 4 | 4 |
| | Running | Visually observed | 4 | 4 | 4 | 4 | 4 | 4 | 1 | 4 | 4 | 4 |
| | Water resistance | Visually observed | 3 | 3 | 3 | 3 | 3 | 3 | 1 | 1 | 1 | 1 |
| | Surface unevenness after printing | Visually observed | 3 | 3 | 3 | 3 | 3 | 3 | 3 | 3 | 3 | 3 |

As can be seen in Tables 1 to 6, the porous resin film of the invention (Examples 1 to 9) exhibits little density unevenness and a very good ink absorbency even if the ejected amount of ink is great. Further, in the case where an ink-receptive layer comprising the inorganic filler and binder of the invention is provided on the porous resin film (Examples 10 to 15, 19 to 22), the porous resin film exhibits a good ink absorbency and a good running resistance, demonstrating that the effect of the present can be definitely exerted. Further, the provision of a top coat layer on the ink-receptive layer (Examples 16 to 18, 23, 24) causes enhancement of surface gloss.

On the contrary, all the films having a liquid absorption capacity deviating from the scope of the invention (Comparative Examples 1, 2) exhibit a deteriorated ink absorbency. Further, the comparison of the examples with Comparative Example 3 shows that the porous resin film of the invention exhibits no surface unevenness after printing, demonstrating that the effect of the present can be definitely exerted. Further, the ink jet recording paper comprising a porous resin film deviating from the scope of the invention (Comparative Examples 5, 10) and the ink jet recording paper comprising an ink-receptive layer deviating from the scope of the invention (Comparative Examples 4, 6 to 9, 11 to 13) cannot meet the aforementioned requirements and thus exhibit deteriorated performance.

INDUSTRIAL APPLICABILITY

The porous resin film of the invention exhibits an extremely good absorption of aqueous solvent and ink. Further, the recording medium of the invention comprising the aforementioned porous resin film can form a fine image free of density unevenness thereon even if the ejected amount of ink is great. Accordingly, the porous resin film and recording medium of the invention can be preferably provided for a wide printing purpose such as recording with an aqueous ink, particularly ink jet recording medium, or purpose using an aqueous solvent.

What is claimed is:

1. A porous resin film comprising:

a thermoplastic resin in an amount of 30 to 90% by weight; and at least one of an inorganic or organic finely divided powder having an average particle diameter of from 3 to 20 $\mu$m in an amount of 10 to 70% by weight, wherein the finely divided powder is surface-treated with (A) a surface treating agent comprising a copolymer comprising copolymerized units of at least one of (a1) a diallylamine salt or an alkyl diallylamine salt and (a2) a nonionic hydrophilic vinyl monomer, and (B) an anionic surface treating agent, and the porous resin film has a liquid absorption capacity of not smaller than 0.5 ml/m$^2$ as measured by Japan TAPPI No. 5 1-87.

2. The porous resin film as claimed in claim 1, which has an average water contact angle of not greater than 110°.

3. The porous resin film as claimed in claim 1, which has a porosity of not smaller than 10%.

4. The porous resin film as claimed in claim 1, wherein the thermoplastic resin is a polyolefin resin.

5. The porous resin film as claimed in claim 1, wherein the content of the thermoplastic resin is from 30 to 90% by weight, the content of the surface-treated finely divided powder is from 10 to 70% by weight, and the amount of the surface treating agent (A) and the anionic surface treating agent (B) are each from 0.01 to 10 parts by weight based on 100 parts by weight of the finely divided powder.

6. The porous resin film as claimed in claim 1, which is stretched.

7. The porous resin film as claimed in claim 1, which is subjected to oxidation on the surface thereof.

8. A laminate comprising a porous resin film as claimed in claim 1 provided on at least one surface of a substrate layer.

9. A recording medium comprising a porous resin film as claimed in claim 1.

10. An ink jet recording medium comprising a porous resin film as claimed in claim 1.

11. An ink jet recording medium comprising an ink-receptive layer provided on at least one surface of a porous resin film as claimed in claim 10.

12. The ink jet recording medium as claimed in claim 11, wherein the ink-receptive layer has a surface gloss of not smaller than 40% measured at 60° according to JIS-Z8741.

13. The ink jet recording medium as claimed in claim 11, wherein the ink-receptive layer comprises an inorganic filler having an average particle diameter of not greater than 350 nm in an amount of from 70 to 95% by weight and a binder resin in an amount of from 70 to 95% by weight and from 5 to 30% by weight.

14. The inkjet recording medium as claimed in claim 13, wherein the inorganic filler comprises at least one selected from the group consisting of amorphous silica, alumina and alumina hydrate.

15. The ink jet recording medium as claimed in claim 14, wherein the amorphous silica is obtained by agglomerating primary particles having an average diameter of from 1 nm to 10 nm.

16. The ink jet recording medium as claimed in claim 14, wherein the amorphous silica is a cationically treated silica.

17. The ink jet recording medium as claimed in claim 14, wherein the alumina is δ-alumina.

18. The ink jet recording medium as claimed in claim 14, wherein the alumina hydrate is pseudo-boehmite.

19. The ink jet recording medium as claimed in claim 11, wherein the ink-receptive layer comprises a crosslinking agent in an amount of from 1 to 20% by weight and an ink fixing agent incorporated therein each in an amount of from 1 to 20% by weight.

20. The ink jet recording medium as claimed in claim 11, further comprising a top coat layer provided on the ink-receptive layer and having a surface gloss of not smaller than 50% measured at 60° according to JIS-Z8741.

21. The ink jet recording medium as claimed in claim 20, wherein the top coat layer comprises an inorganic filler having an average particle diameter of not greater than 350 nm in an amount of from 70 to 95% by weight and a binder resin in an amount of from 5 to 30% by weight.

22. The ink jet recording medium as claimed in claim 20, wherein the top coat layer comprises an ink fixing agent incorporated therein in an amount of from 1 to 20% by weight.

* * * * *